US008480011B2

(12) United States Patent
Endo

(10) Patent No.: US 8,480,011 B2
(45) Date of Patent: Jul. 9, 2013

(54) NOZZLE SYSTEM AND METHOD

(75) Inventor: Seiji Endo, Gyoda (JP)

(73) Assignee: Dehn's Innovations, LLC, Dallas, TX (US)

( * ) Notice: Subject to any disclaimer, the term of this patent is extended or adjusted under 35 U.S.C. 154(b) by 586 days.

(21) Appl. No.: 12/204,646

(22) Filed: Sep. 4, 2008

(65) Prior Publication Data

US 2009/0057443 A1 Mar. 5, 2009

(30) Foreign Application Priority Data

Sep. 4, 2007 (JP) ..... 2007-228900
Sep. 4, 2007 (JP) ..... 2007-228901

(51) Int. Cl.

| | |
|---|---|
| ***B05B 3/06*** | (2006.01) |
| ***B05B 7/30*** | (2006.01) |
| ***B05B 7/12*** | (2006.01) |
| ***B05B 9/01*** | (2006.01) |
| ***A62C 5/02*** | (2006.01) |
| ***F23D 11/10*** | (2006.01) |

(52) U.S. Cl.
USPC ..... 239/251; 239/226; 239/310; 239/318; 239/416.5; 239/418; 239/526

(58) Field of Classification Search
USPC ..... 239/214, 222.13, 223, 224, 225.1, 239/226, 227, 229, 264, 310, 318, 355, 373, 239/383, 398, 399, 405, 416.5, 417.3, 418, 239/526, 237, 238, 239, 240, 381, 382, 222.15, 239/222.16, 222.17, 251
See application file for complete search history.

(56) References Cited

U.S. PATENT DOCUMENTS 4,370,771 A * 2/1983 Gonzalvo ..... 15/29
5,533,673 A * 7/1996 Wilson et al. ..... 239/227

(Continued)

FOREIGN PATENT DOCUMENTS

DE 1806634 5/1970
JP H0437635 2/1992

(Continued)

*Primary Examiner* — Ryan Reis
(74) *Attorney, Agent, or Firm* — Meyertons, Hood, Kivlin, Kowert & Goetzel, P.C.; Eric B. Meyertons

(57) ABSTRACT

Provided is a spray nozzle, that includes a stationary tube and a rigid rotor. The stationary tube has a proximal, a distal end opposite the proximal end, and a tube passage that extends from substantially at or near the proximal end of the stationary tube to substantially at or near the distal end of the stationary tube. The stationary tube is configured to communicate substantially at or near the proximal end with a pressurized air source The rigid rotor has a distal end rotatably coupled substantially at or near the distal end of the stationary tube, a proximal end comprising an outlet port substantially at or near the proximal end and a rotor passage in fluid communication with the stationary tube. The rotor passage extends from substantially at or near the distal end of the rotor to substantially at or near the proximal end of the rotor. Further, the rotor passage is configured to remain in fluid communication with the tube passage during rotation of the rotor relative to the stationary tube about a rotor axis of rotation. The outlet port is offset a radial distance in a radial direction from the rotor axis substantially at or near at a distal end of the rotary member, and ejection of the pressurized air from the outlet port is configured to produce directional components of the pressurized air in the direction of rotation about the rotor axis of rotation.

40 Claims, 9 Drawing Sheets

U.S. PATENT DOCUMENTS

| | | | | |
|---|---|---|---|---|
| 6,178,570 | B1 * | 1/2001 | Denst et al. | 4/541.6 |
| 6,860,437 | B1 * | 3/2005 | Amendt et al. | 239/383 |
| 6,883,732 | B2 * | 4/2005 | Hasegawa | 239/416.5 |
| 7,458,485 | B2 * | 12/2008 | Amron | 222/79 |
| 7,530,474 | B2 * | 5/2009 | Amron | 222/79 |
| 7,753,059 | B2 | 7/2010 | Hasegawa | |
| 7,878,423 | B2 | 2/2011 | Hasegawa | |
| 2005/0173559 | A1 * | 8/2005 | Eddins et al. | 239/302 |
| 2006/0065760 | A1 * | 3/2006 | Micheli | 239/237 |
| 2010/0176219 | A1 | 7/2010 | Hasegawa | |

FOREIGN PATENT DOCUMENTS

| | | |
|---|---|---|
| JP | H10286494 | 10/1998 |
| JP | H11123350 | 5/1999 |
| JP | 200051800 | 2/2000 |
| JP | 2001104840 | 4/2001 |
| JP | 2003154294 | 5/2003 |
| JP | 2007228900 | 9/2007 |
| JP | 2007228901 | 9/2007 |
| WO | 2007131533 | 11/2007 |

* cited by examiner

NOZZLE SYSTEM AND METHOD

PRIORITY OF THE INVENTION

This application claims priority to Japanese Patent Application No. 2007-228900 filed on Sep. 4, 2007 and Japanese Patent Application No. 2007-228901 filed on Sep. 4, 2007, which are herein incorporated by reference.

BACKGROUND

1. Field of the Invention

The present invention relates to a rotary spray nozzle for ejecting or dispersing a jet of pressurized air, liquid, and/or other medium.

2. Description of Related Art

Many devices have been used for cleaning dust and dirt from a surface. Some such devices clean a surface by spraying a gas (e.g., compressed air) from an opening of a nozzle in a cleaning device. Other devices clean a surface by forcing a liquid, a powder, or a granular polishing agent through an opening of the device using a high-pressure air. Conventional device, therefore, tend to have a structure that forces high-pressure air and/or a cleaning fluid or other medium through a nozzle of the device.

Japanese Patent Publication No. 2001-104840 describes a flexible nozzle made of a flexible cylindrical member and arranged to turn along the inner side of a horn-like guide. Japanese Patent Publication No. 2008-154294 describes a nozzle in which pressurized gas is sprayed together with liquid, while a flexible nozzle having an inside/outside double structure of flexible tube materials, is rotated within a trumpet-shaped control member. The flexible nozzle is made of synthetic resin, such as nylon and polypropylene, and by powerfully spraying the pressurized gas from spray ports of its tip end, a negative-pressure zone is formed there around, and a sub-medium is sucked by the negative pressure, aerosoled, and sprayed against an object to be sprayed together with the pressurized gas. By spraying the pressurized gas from the tip end (free end) of the flexible nozzle, a whole body of this nozzle is rotated due its reaction force, and the tip end draws a circumferential track along an inner circumferential surface of the trumpet-shaped control member. By spraying the pressurized gas while the tip end is rotated and moved, a pressure wave of the sprayed pressurized gas is amplified, thereby increasing a spraying force. The sub-medium is rotated and diffused, thus making it possible to obtain aerosol having a very small diameter. A cleaning device, a painting device, and a blast device, etc, are provided as examples of specific purposes of use of the spray apparatus, and a liquid detergent, paint in a state of liquid or granular solids, and a powdery or granular blast material (granular solids) may be used as the sub-medium.

Such flexible nozzles, however, may have certain limitations. For example, since a significant pressure at the ejection of pressurized air is needed to stably turn the flexible nozzle, the flexible nozzle may be conducive for use in high-pressure applications, but not conducive for use in low-pressure applications, such as a blower for producing a delicate blow of pressurized air. Further, the use of a horn-like guide to constrain the flexible nozzle to produce the turning action at a desired diameter may create a significant amount of contact between the flexible nozzle and the guide. The contact may result in contamination and wearing of each of the components. The resistance to movement due to the wear between the nozzle and the inner side of the guide may increase and reduce the ability of the nozzle to rotate. Further, a flexible nozzle, such as that made of a synthetic resin material, may be susceptible to certain environmental conditions. For example, the flexible nozzle may harden during the winter or in a cold climate, thereby reducing the ability of the nozzle to rotate and lessening the ability to provide the desired dispersion of the pressurized air in a turning movement.

SUMMARY

Various embodiments of a nozzle system and method are provided. In one embodiment provided is a spray nozzle that includes a stationary tube and a rigid rotor. The stationary tube has a proximal, a distal end opposite the proximal end, and a tube passage that extends from substantially at or near the proximal end of the stationary tube to substantially at or near the distal end of the stationary tube. The stationary tube is configured to communicate substantially at or near the proximal end with a pressurized air source. The rigid rotor has a distal end rotatably coupled substantially at or near the distal end of the stationary tube, a proximal end comprising an outlet port substantially at or near the proximal end, and a rotor passage in fluid communication with the stationary tube. The rotor passage extends from substantially at or near the distal end of the rotor to substantially at or near the proximal end of the rotor. Further, the rotor passage is configured to remain in fluid communication with the tube passage during rotation of the rotor relative to the stationary tube about a rotor axis of rotation. The outlet port is offset a radial distance in a radial direction from the rotor axis substantially at or near at a distal end of the rotary member, and ejection of the pressurized air from the outlet port is configured to produce directional components of the pressurized air in the direction of rotation about the rotor axis of rotation.

In another embodiment, provided is a spray apparatus that includes a spray nozzle and a pressurized air source. The spray nozzle includes a stationary tube and a rigid rotor. The stationary tube has a proximal, a distal end opposite the proximal end, and a tube passage that extends from substantially at or near the proximal end of the stationary tube to substantially at or near the distal end of the stationary tube. The stationary tube is configured to communicate substantially at or near the proximal end with a pressurized air source. The rigid rotor has a distal end rotatably coupled substantially at or near the distal end of the stationary tube, a proximal end comprising an outlet port substantially at or near the proximal end, and a rotor passage in fluid communication with the stationary tube. The rotor passage extends from substantially at or near the distal end of the rotor to substantially at or near the proximal end of the rotor. Further, the rotor passage is configured to remain in fluid communication with the tube passage during rotation of the rotor relative to the stationary tube about a rotor axis of rotation. The outlet port is offset a radial distance in a radial direction from the rotor axis substantially at or near at a distal end of the rotary member, and ejection of the pressurized air from the outlet port is configured to produce directional components of the pressurized air in the direction of rotation about the rotor axis of rotation. Further, the pressurized air source is in fluid communication with the tube passage of the spray nozzle.

In another embodiment, provided is a spray nozzle that includes a stationary tube, a rigid rotor, and a hollow inner tube. The stationary tube has a proximal, a distal end opposite the proximal end, and a tube passage that extends from substantially at or near the proximal end of the stationary tube to substantially at or near the distal end of the stationary tube. The stationary tube is configured to communicate substantially at or near the proximal end with a pressurized air source.

The rigid rotor has a distal end rotatably coupled substantially at or near the distal end of the stationary tube, a proximal end comprising an outlet port substantially at or near the proximal end, and a rotor passage in fluid communication with the stationary tube. The hollow inner tube has a first inner tube portion disposed in the tube passage, and a second inner tube portion disposed in the rotor passage. The hollow inner tube defines annular region between an outer diameter of the hollow inner tube and the inner diameter of the tube passage and the rotor passage.

In yet another embodiment, provided is a spray apparatus that includes a spray nozzle, a pressurized air source, and a sub-medium supply source. The stationary tube has a proximal, a distal end opposite the proximal end, and a tube passage that extends from substantially at or near the proximal end of the stationary tube to substantially at or near the distal end of the stationary tube. The stationary tube is configured to communicate substantially at or near the proximal end with a pressurized air source. The rigid rotor has a distal end rotatably coupled substantially at or near the distal end of the stationary tube, a proximal end comprising an outlet port substantially at or near the proximal end, and a rotor passage in fluid communication with the stationary tube. The hollow inner tube has a first inner tube portion disposed in the tube passage, and a second inner tube portion disposed in the rotor passage. The hollow inner tube defines annular region between an outer diameter of the hollow inner tube and the inner diameter of the tube passage and the rotor passage. The pressurized air source is configured to deliver pressurized air to the spray nozzle. The sub-medium supply source is in fluid communication with the hollow inner tube, wherein a negative pressure created at the outlet port is configured to suck sub-medium from the sub-medium supply through the hollow inner tube.

BRIEF DESCRIPTION OF THE DRAWINGS

Advantages of the present invention will become apparent to those skilled in the art with the benefit of the following detailed description and upon reference to the accompanying drawings in which:

FIG. 2(*b*) is a front view of the spray nozzle in accordance with an embodiment of the present technique.

FIG. 3(*b*) is a front view of the spray nozzle in accordance with an embodiment of the present technique.

FIG. 4(*b*) is a front view of the spray nozzle in accordance with an embodiment of the present technique.

FIG. 5(*b*) is a front view of the spray nozzle in accordance with an embodiment of the present technique.

FIG. 7(*b*) is a front view of the spray nozzle in accordance with an embodiment of the present technique.

FIG. 7(*c*) is a partially magnified detailed view of FIG. 7(*b*) in accordance with an embodiment of the present technique.

FIG. 8(*b*) is a front view of the spray nozzle in accordance with an embodiment of the present technique.

FIG. 9(*b*) is a front view of the spray nozzle in accordance with an embodiment of the present technique.

FIG. 10(*b*) is a front view of the spray nozzle in accordance with an embodiment of the present technique.

FIG. 11(*b*) is a front view of the spray nozzle in accordance with an embodiment of the present technique.

Figure 1:
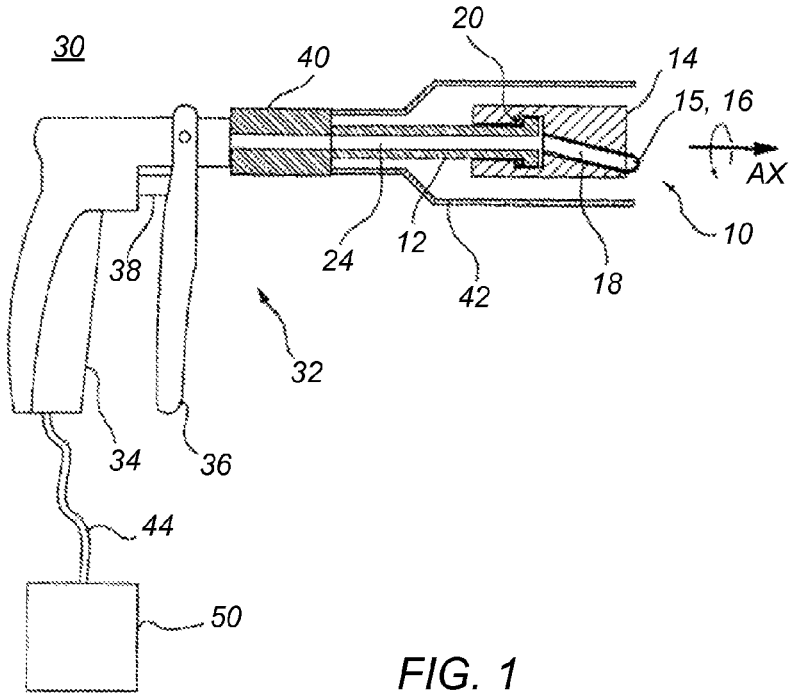
FIG. 1 is a partially longitudinally cross sectional schematic (side) view of a spray apparatus equipped at the distal end with a spray nozzle in accordance with an embodiment of the present technique.

While the invention is susceptible to various modifications and alternative forms, specific embodiments thereof are shown by way of example in the drawings and will herein be described in detail. The drawings may not be to scale. It should be understood, however, that the drawings and detailed description thereto are not intended to limit the invention to the particular form disclosed, but to the contrary, the intention is to cover all modifications, equivalents, and alternatives falling within the spirit and scope of the present invention as defined by the appended claims.

DETAILED DESCRIPTION OF ILLUSTRATIVE EMBODIMENTS

Spraying devices are described in the following Japanese Patent Applications all of which are incorporated herein by reference: Japanese Publication No. 2000-51800; Japanese Publication No. H11-123350; Japanese Publication No. H04-37635; Japanese Publication No. H10-286494; and Japanese Publication No. 2001-104840. Further, spraying devices are described in the U.S. Pat. No. 6,883,732 by Hasegawa entitled "Fluid Spraying Apparatus, Method, and Container", issued Apr. 26, 2005, which is incorporated herein by reference.

Embodiments of the invention have been developed in view of eliminating the foregoing problems with an objective of providing a spray apparatus for ejecting and dispersing a jet of pressurized air from a rotating outlet, and, more particularly, a spray apparatus for allowing the distal end to be smoothly turned by the ejection of a small amount of a relatively low-pressure gas regardless of the environmental conditions (e.g., the temperature), while preventing fouling or wearing. Another object of certain embodiments of the present invention is to provide a spray apparatus equipped with the spray nozzle described above. Embodiments include a rotary member made of a rigid material that includes a flow passage provided therein for producing a rotational force created by a counter force of the ejection of pressurized air. The rotary member, in certain embodiments, is rotatably joined to a stationary tube that communicates with a pressurized air supply source such that the pressurized air can be ejected and dispersed with out the use of flexible tube or a horn-like guide.

The spray nozzle, in some embodiments, allows the rotary member constituting a portion of the passage of the pressurized air to be made of a rigid material and rotatably joined to the distal end to the stationary tube, hence eliminating the problems residing in the conventional flexible air blow nozzle that is rotatably arranged. That is, in certain embodiments, there is reduced or no collision or wear between the distal end of the nozzle and the inner side of the horn-like guide. Further, the rotation of the nozzle can start immediately upon the ejection of the pressurized air regardless of the temperature where used, in some embodiments.

In certain embodiments the effect of increasing the pressure waves of the pressurized air can be obtained with the nozzle starting rotation even if the pressure of the pressurized air is relatively low. Thus, in certain embodiments, ejection of the pressurized air can be applied to a delicate object, such as feather fabric.

Further, the air blow nozzle, according to certain embodiments, can be used as a dust blower that produces a jet of pressurized air to remove dusts from a target area at the extension of the axis of rotation while continuously applying a force of ejection onto a surrounding region about the area. In such an embodiment, even when the fabric or elastic object to be cleaned is fouled with dusts or sticky dirt, it can be cleaned by continuously applying the force of the ejection onto the surrounding region about the dust area, like hitting a futon fabric with a futon stick for lifting and removing dusts.

In some embodiments of the present invention, the rotary member and the stationary tube may be joined rotatably to each other by a bearing. In such an embodiment, the inclusion of a bearing allows the rotating friction acting the rotary member to be reduced while the rotary member is stably rotated by the ejection of the pressurized air at a relatively lower pressure, a small amount, or at a lower temperature.

In other embodiments of the present invention, the rotary member has two or more outlet ports provided at the opening end thereof and located symmetrically with respect to the axis of rotation. Such an embodiment permits counter forces in the radial direction of the ejection of the pressurized air to be balanced, thus, ensuring the stable rotation of the rotary member without being off-centered. In certain embodiments, the outlet ports equally face the direction of rotation, and the counter forces of the ejection of the pressurized air remains aligned in the direction of rotation, thus causing the rotary member to rotate in the direction opposite to the direction of the ejection.

In some embodiments of the present invention, the rotary member has an axially blowing fan provided for producing an axial flow along the axis of the rotary member. Such embodiments may allow the pressurized air ejected from the outlet ports to be decreased in the component for rotation and increased in the axial component. Thus, in certain embodiments, the pressurized air can be prevented from over-dispersing while its ejection along the axial direction is increased.

In certain embodiments of the present invention, the rotary member may include a brush that projects from the distal end thereof. In such an embodiment, the spray apparatus may directly sweep with the action of the brush in addition to providing a force due ejection of the pressurized air, thereby further improving the dust removing capability.

Further, in order to solve certain above-described problems, some embodiments of the present invention include a tip end of an outer tube constituting the spray nozzle having an inner/outer double tube structure that is formed in a passage of the rotor and having a flow passage for the pressurized gas. In certain embodiments, the rotor, constituting a part of the flow passage of the pressurized gas, is made of the hard material and is rotatably fitted to the tip end of a fixed outer tube. In such an embodiment, it may be possible to solve the above-described problem of the conventional spray nozzle, in which the whole part of the flexible nozzle that moves unconstrained/unruly by the spray of the pressurized gas is rotated along the inner surface of the trumpet-shaped guide. In such an embodiment, by spraying pressurized gas of a small amount or at relatively low pressure, the rotor can be rotated appropriately by an associated spray reaction force. In addition, in such an embodiment, there may be no deterioration of the nozzle and no corruption of the inner surface of the guide due to the friction between the nozzle and the inner surface of the guide. In such embodiments, the sub-medium may be sucked and rotatory-diffused appropriately, independent of the temperature.

Therefore, in certain embodiments of the spray apparatus, the nozzle is stably rotated even by the spray of a small amount of pressurized gas and pressurized gas having a low pressure. Such embodiments help to prevent splashing of the sub-medium and/or deviation of the sub-medium from a spray target. These embodiments make it possible to achieve cleaning, painting, and blasting even when the spray target requires fine spray. In addition, in some embodiments, the pressure wave of the pressurized gas is amplified, thereby making it possible to obtain aerosol spray having a very small diameter, with the sub-medium diffused appropriately, and also possible to spray this aerosol toward the spray target with a high spraying force.

In certain embodiments, a plurality of spray ports are opened and formed in the rotor, and each spray port may be provided in a rotation symmetric position with respect to the rotary shaft. In such an embodiment, the reaction force about the diameter is balanced to allow the rotor to rotate smoothly around the fixed outer tube, without being decentered (e.g., without wobbling). Further, by making each spray port be directed to the same rotational direction, the sub-medium is sprayed in all directions around the rotary shaft in a balanced manner, and the spray reaction force of the pressurized gas received by each spray port is not canceled in the rotational direction, thus making it possible to rotate the rotor.

In certain embodiments, tan opening end of the tip end side of the inner tube for spraying the sub-medium is disposed in the vicinity of the outlet ports or inside of the passage of the rotor. In an embodiment in which the opening end of the inner tube is disposed inside of the negative pressure zone formed by the spray of the pressurized gas, and the sub-medium may be sucked from the sub-medium supply source and delivered through the inner tube. Accordingly, in some embodiments, it may not be necessary to add to the sub-medium supply source an inner pressure above the atmospheric pressure. Such an embodiment may help to simplify the spray apparatus and improve handleability.

In some embodiments, the rotor and the fixed outer tube may be connected rotatably by bearing. Such an embodiment may help to reduce a rotational friction that acts on the rotor, and the rotor may be rotated appropriately even by a small amount of spray of the pressurized gas or even when being used at a low temperature.

In certain embodiments, an axial flow fan may be provided for generating an axial flow in an axial direction of the rotor. In such an embodiment, a rotation component of the gas sprayed from the rotating outlet ports is suppressed, thus increasing a component in the axial direction. In such an embodiment, where there may be excess spray of the pressurized gas in the radial direction that excessively diffuses the sub-medium, the rotation of the rotor can be suppressed by the axial flow fan and the spraying force in the axial direction can be increased.

In some embodiments, a brush may be disposed on and protrude from the tip end of the rotor. In such an embodiment, when the spray apparatus of the present invention is used for cleaning and blasting, it may be possible to obtain a direct brushing effect for the spray target by using the brush. Such an embodiment may make it possible to further increase a dust removing performance or clean a blast surface.

Turning now to the figures, FIG. 1 is a partially longitudinally cross sectional, schematic (side) view of a spray (air blow) nozzle 10 and a spray (air blow) apparatus 30 equipped at the distal end (at the right in the drawing) with the spray nozzle 10, showing a first embodiment of the present invention. The arrangement of the spray nozzle 10, a joint 40, and a cover 42 is illustrated in the longitudinally cross sectional view taken along the vertical line through along the axis of rotation (AX).

Figure 2A:
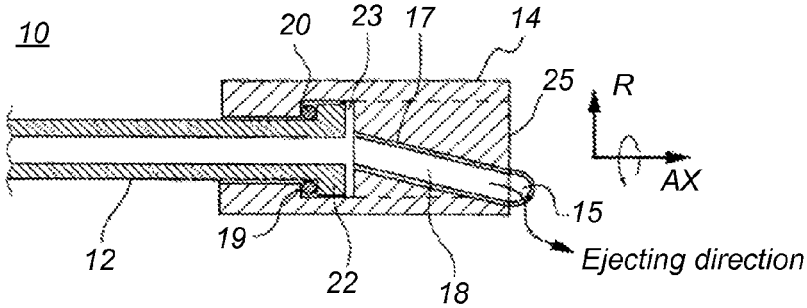
FIG. 2(*a*) is a side view of the spray nozzle taken across line 2A-2A of FIG. 2(*b*) in accordance with an embodiment of the present technique.
Figure 2B:
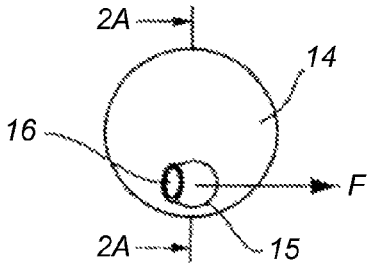

FIG. 2(*a*) is a partially longitudinally cross sectional schematic (side) view of the spray nozzle 10 of the present embodiment. The cross sectional view of FIG. 2(*a*) corresponds to a view taken along the line 2A-2A of the FIG. 2(*b*). The proximal end (at the left in the drawing) of a fixed (stationary) tube 12 is not shown. FIG. 2(*b*) is a front view of the spray nozzle 10.

The spray apparatus 30 of the present embodiment is provided in the form of a spray apparatus (e.g., a dust blower) for ejecting a jet of pressurized air to remove dusts and generally comprises a spray gun 32, a pressurized air/gas source 50, and pressured air (not shown) stored therein.

The spray gun 32 comprises a gun main body 34 with the joint 40 having a pressurized air flow passage provided therein, a lever 36, a valve 38 for communicating between the flow passage and the pressurized gas source 50 with the action of the lever 36, the spray nozzle 10 of the present invention connected to the distal end of the joint 40, and the horn-like cover 42 for protecting the spray nozzle 10. The gun main body 34 and the pressurized gas source 50 are communicated to each other by a flexible tube 44.

In use, the valve 38 opens the flow passage when the lever 36 is pulled by the hand of an operator and allows the pressurized air stored in the pressurized gas source 50 to be ejected from the distal end of the spray nozzle 10. When the lever 36 is returned back to its original position by user, the valve 38 closes the flow passage to stop the flow of the pressurized air.

The pressurized air is not limited to compressed air ranging from a few MPa to tens of MPa but may be selected from inert gas such as nitrogen or carbon dioxide and substitute flow gases. In one embodiment, when the valve 38 opens, the pressurized air is de-pressurized to not greater than 1 MPa but higher than the atmospheric level, to be ejected from the outlet port (blow outlet) 16 of the spray nozzle 10.

The spray nozzle 10 of the present invention has a rotor 14 that is rotatably joined to the distal end of the fixed tube 12 which is fixedly joined to the spray gun 32.

The fixed tube 12 is airtightly joined at the proximal end (at the left in the drawing) to the joint 40 for communication with the pressurized gas source 50 while serving as a flow passage. The joint between the proximal end of the fixed tube 12 and the joint 40 is not particularly limited but may preferably be implemented by a combination of male thread provided on the outer side at the proximal end of the fixed tube 12 and female thread provided in the distal end of the joint 40 which both are closely engaged with each other.

The shape along the centerline or in the cross section of the fixed tube 12 is of no limitations although it has a circular shape in the illustrated cross section and is linearly extended along the centerline in the illustrated embodiment.

In this embodiment, the direction along which the distal end of the fixed tube 12 extends or the center in the cross section of the fixed tube 12 is matched with the axis of rotation (AX) of the rotor 14. As long as the rotor 14 is rotatable in relation to the distal end of the fixed tube 12 and the pressurized air to be ejected does not leak from a gap between the fixed tube 12 and the rotor 14, the matching between the center line in the cross section of the fixed tube 12 and the axis of rotation of the rotor 14 is not mandatory. For example, the axis of rotation may be offset from the centerline of the fixed tube 12 or the fixed tube 12 may extend offset from or away from the axis of rotation.

The rotor 14 has a passage 18 provided therein for communication with the fixed tube 12. The fixed tube 12 and the rotor 14 are joined to each other rotatably and airtightly, whereby the pressurized air derived from the pressurized gas source 50 through the fixed tube 12 can be conveyed through the passage 18 to be ejected from a nozzle tip 15.

The nozzle tip 15 is provided at the distal end (at the right in the drawing) of the passage 18 communicated with the fixed tube 12 and specifically situated at a location which is offset a distance in the radial direction (R) from the axis of rotation (AX) of the rotor 14. Also, the outlet port 16 is provided in the nozzle tip 15 and has an opening in a direction which intersects both the axis of rotation and the radial direction. In other words, the ejection of the pressurized air which is normal to the opening of the outlet port 16 is contemplated to produce directional components of the pressurized air along the direction of rotation about the axis of rotation.

Accordingly, when the pressurized air stored in the pressurized gas source 50 is ejected from the outlet port 16, it allows the nozzle tip 15 to receive a counter force F as shown in FIG. 2(*b*) and causes the rotor 14 with the nozzle tip 15 to spin about the axis of rotation. In the spray nozzle 10 of the illustrated embodiment, the outlet port 16 extends in a direction intermediate between the axis of rotation and the direction of rotation about the axis of rotation. This permits the rotor 14 with the outlet port 16 to rotate counter-clockwise, as viewed from the front of the axis of rotation, when the pressurized air is ejected from the outlet port 16.

Accordingly, since the outlet port 16 in spray nozzle 10 moves along a circle of which the radius is equal to the offset distance of the nozzle tip 15 from the axis of rotation, its rotating action can amplify the pressure waves of the pressurized air ejected along the directional components about the axis of rotation.

The fixed tube 12 and the rotor 14 are made of a rigid material that remains significantly undeformed by the ejection of the pressurized air. Particularly, they may be made of a hard plastic material or a metallic material. Preferably, the fixed tube 12 is made of a metallic material such as stainless steel for increasing the resistance to pressure and the operational durability while the rotor 14 is made of a hard plastic material such as poly-urethane doped with a plasticizer in terms of lowering inertia moment and smoothly rotating.

In the spray nozzle 10 of the present embodiment, the fixed tube 12 and the rotor 14 are joined to each other by a bearing 20, such as a roller bearing or a slider bearing.

The fixed tube 12 has a flange 22 provided at the distal end thereof. On the other hand, the rotor 14 has a chamber 23 provided in the proximal end thereof for accepting the flange 22 and the bearing 20. The chamber 23 at the proximal end is defined by a thick portion 19 which is sized smaller in the diameter than the flange 22 and greater than the fixed tube 12. With the bearing 20 disposed between the flange 22 and the thick portion 19, the fixed tube 12 and the rotor 14 are joined to each other so that they can rotate about the axis that extends across the center in the cross section of the fixed tube 12.

In the spray nozzle 10 of the present embodiment, a pipe 17 is embedded in the rotor 14 for providing the passage 18. The pipe 17 is arranged rotatably about the axis of the rotor 14 and its proximal end is matched with or substantially overlapped with the axis of rotation (AX). As the pipe 17 is opened at the proximal end to the chamber 23, it communicates with the fixed tube 12. The distal end of the pipe 17 is situated at a location offset distanced from the axis of rotation while the nozzle tip 15 is bent at the opening end such that the outlet port 16 is configured to produce a directional component along (e.g., parallel to) the axis of rotation and directional component about the axis of rotation.

The material and shape of the pipe 17 is not limited and may be implemented by a circular tube of hard plastic material. Although the pipe 17 is a straight pipe tilted from the axis of rotation as illustrated, it may be implemented by a curved pipe or a bent pipe.

The spray nozzle 10 of the present embodiment can be fabricated by the following procedure.

The procedure starts with enlarging the diameter at the distal end of a metallic tube to prepare the fixed tube 12 provided with the flange 22. The rotor 14 of a cylindrical shape which is sized smaller at the proximal end and greater at the distal end in the diameter is made from a hard plastic material. The smaller diameter at the proximal end of the fixed tube 12 is matched with the inner diameter of the thick portion 19 while the larger diameter at the distal end is matched with the inner diameter at the chamber 23 as denoted by the broken line in FIG. 2(*a*).

The fixed tube 12 loaded at the outer side with the bearing 20 is inserted from its distal end side into the rotor 14. Since the inner diameter of the thick portion 19 of the rotor 14 is smaller than the diameter of the flange 22 of the fixed tube 12, the flange 22 acts as a stopper so that the flange 22 and the thick portion 19 are abutted (e.g., coupled) to each other by the bearing 20.

The pipe 17, which has been formed at the distal end in a given shape, is inserted from the distal end side into the rotor 14 and temporarily fixing the pipe 17.

The rotor 14 is filled with a melted form of resin material 25 to fix the temporarily fixed pipe 17 while its distal end is closed to develop the chamber 23 therein. The resin material 25 injected into the distal end side of the rotor 14 may be the same as or different from that of the rotor 14.

As described, the fixed tube 12 and the rotor 14 are made of the rigid material and coupled to one another by the bearing 20, whereby their parts can hardly be deformed by a counter force of the ejection of the pressurized air hence eliminating the internal loss of the ejection energy of the pressurized air.

Since the rotor 14 is arranged of a cylindrical shape about the axis of rotation with its nozzle tip 15 and outlet port 16 located in the area of the distal end side of the rotor 14, it provides no projections in radial directions when rotating and allows user or other workers to use the spray apparatus 30 of the present invention safely.

The cover 42 used in the present invention does not directly contact the rotor 14 and, as such, may not foul or wear the inner side of the rotor 14. The cover 42 is not limited to any particular shape, so long as it does not directly contact the rotor 14 during the rotating action, but its distal end may be projected from the outlet port 16 towards the front to form a visor for avoiding over-dispersion of the pressurized air ejected from the outlet port 16 which is turning. For example, the cover 42 is mounted to the joint 40 in the gun main body 34. The cover 42 may be joined detachably to the gun main body 34.

In the present invention, the passage 18 may be provided by making a through bore in the rotor 14 of a solid form. The rotor 14 may be composed of two separate parts that are joined to each other when the fixed tube 12 and the bearing 20 have been assembled in the rotor 14.

In the present invention, the pipe 17 may be exposed without being embedded completely in the rotor 14. That is, the pipe 17 is made from a rigid material so that its distal end is radially offset by a distance from the axis of rotation and its opening has directional components along the direction of rotation and, thus, may be used as the rotor 14. The rotor 14 may be joined to the distal end of the fixed tube 12 slidably with no use of the bearing for rotating. Alternatively, both may be joined integrally by another axially rotatable member.

Figure 3A:
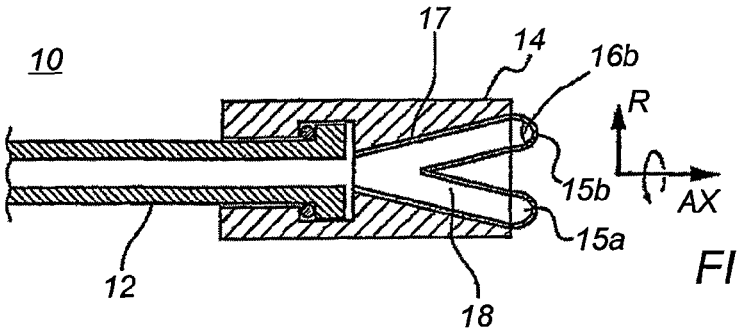
FIG. 3(*a*) is a side view of the spray nozzle taken across line 3A-3A of FIG. 3(*b*) in accordance with an embodiment of the present technique.
Figure 3B:
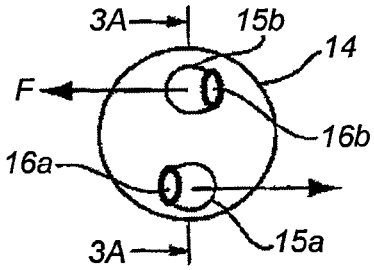

FIG. 3(*a*) is a partially longitudinally cross sectional schematic (side) view of an spray nozzle 10 showing a second embodiment of the present invention and FIG. 3(*b*) is a front view of the same. FIG. 3(*a*) corresponds to a cross-section taken along the line 3A-3A of FIG. 3(*b*).

In the illustrated embodiment the pipe 17 embedded in the rotor 14 is divided into two sections which extend towards the distal end (at the right in the drawing) and bent at the distal end to form nozzle tips 15*a*, 15*b* having their respective outlet ports 16*a*, 16*b*.

In the drawing, upper and lower halves of the rotor 14 are arranged symmetrically with respect to the axis of rotation (AX). Accordingly, the two nozzle tips 15*a*, 15*b* with their respective outlet ports 16*a*, 16*b* are located symmetrically with respect to the axis of rotation. The lower outlet port 16*a* is opened in a direction intermediate between the axis of rotation and the leftward direction in FIG. 3(*b*). The upper outlet port 16*b* is opened in a direction intermediate between the axis of rotation and the rightward direction in FIG. 3(*b*). In other words, the opening of each of two outlet ports 16*a*, 16*b* may be configured to produce directional components of the pressurized air along the direction of rotation and about the axis of rotation. This permits the rotor 14 to rotate counterclockwise along the common direction of rotation, as viewed from the front of the axis of rotation and denoted by the arrow in FIG. 3(*b*), when the pressurized air supplied through the passage 18 in the fixed tube 12 is ejected from the outlet ports 16*a*, 16*b*.

In an embodiment in which the outlet ports 16*a*, 16*b* are located symmetry with respect to the axis of rotation and their openings face the common direction of rotation, the counter forces of the ejection of the pressurized air at the direction components are summed up while the radial components of the pressurized air are offset by each other, the rotor 14 can smoothly rotate about the axis of rotation without being radially off centered from the fixed tube 12 or oscillated in opposite directions.

In the present invention, the outlet ports facing the common direction of rotation means that the counter force of the pressured air ejected from one of the two outlet ports is not interrupted and offset by the counter force of the pressurized air ejected from the other outlet port but not that the two outlet ports have the same opening direction.

Similarly, the outlet ports may be located symmetrically with respect to the axis of rotation means that they are located substantially in balance about the axis of rotation.

While the single pipe 17 has two branches provided with their respective outlet ports 16*a*, 16*b* at the distal end in this embodiment, the fixed tube 12 may be joined rotatably at the distal end to two or more pipes 17, each pipe having one outlet port, directly or indirectly by another connecting member. Alternatively, two or more passages 18 are provided in the solid rotor 14 and communicated with their respective outlet ports 16*a*, 16*b* at the distal end as described previously.

Figure 4A:
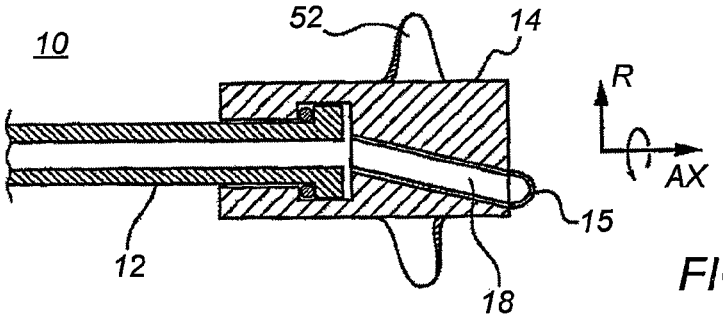
FIG. 4(*a*) is a side view of the spray nozzle taken across line 4A-4A of FIG. 4(*b*) in accordance with an embodiment of the present technique.
Figure 4B:
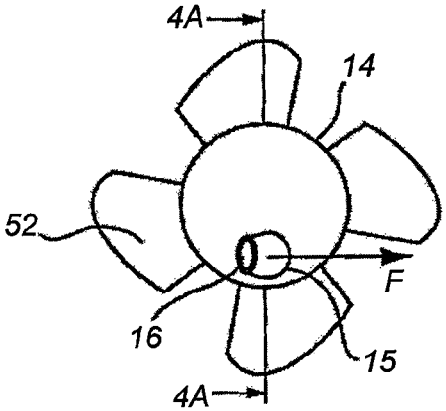

FIG. 4(*a*) is a partially longitudinally cross sectional schematic (side) view of a spray nozzle 10 showing a third embodiment of the present invention and FIG. 4(*b*) is a front view of the same. FIG. 4(*a*) corresponds to a cross-section taken along the line 4A-4A of FIG. 4(*b*).

The illustrated embodiment is different from the first embodiment (FIG. 2) by the fact that the rotor 14 has an axially blowing fan 52 provided on the outer side thereof so that the fan 52 produces a flow of air along the axis of rotation (AX) as the rotor 14 is rotated by the ejection of the pressurized air.

Accordingly, in a case that the pressured air ejected along the radial direction (R) from the outlet port 16 is too great and that along the axis of rotation (AX) is smaller, the spray nozzle 10 of the third embodiment allows the fan 52 on the rotor 14 to produce an axial flow of which the counter force retards the rotating action of the rotor 14, hence increasing the force of the ejection along the axis of rotation with the help of the axial flow.

That is, the action of the fan 52 controls the over-rotating of the rotor 14 thus to attenuate the dispersion of the pressurized air and increases the force of the ejection along the axis of rotation. In this point of view, the action of the axially blowing fan on the rotor 14 in this embodiment can convert the resistive flow produced on the rotor 14 into a propelling flow along the axis of rotation but not make the same into an energy loss, thus, assisting the ejection of the pressurized air, in addition to the use of the resistive flow for controlling the rotating of the rotor 14, thus, enabling adjustment of the of the ejection force along the axis of rotation.

A modification of the spray nozzle 10 of this embodiment may be provided in which the fan 52 is detachably mounted to the rotor 14. This allows the ejection along the axis of rotation to be adjustably increased or decreased depending on the application of the spray apparatus 30.

In a similar point of view, the fan 52 the angle of twist and the mounting angle may be varied in relation to the rotor 14.

Figure 5A:
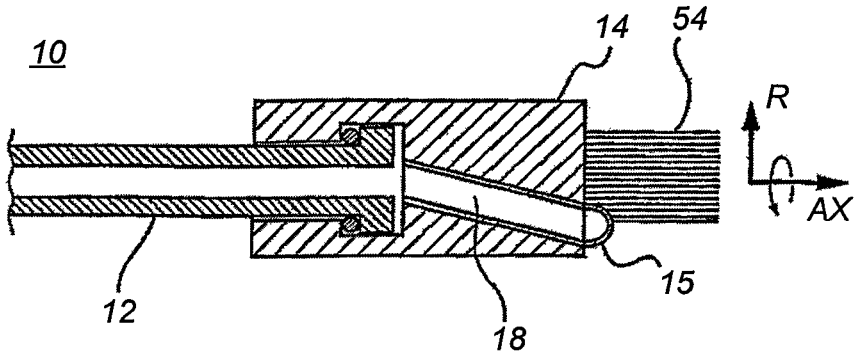
FIG. 5(*a*) is a side view of the spray nozzle taken across line 5A-5A of FIG. 5(*b*) in accordance with an embodiment of the present technique.
Figure 5B:
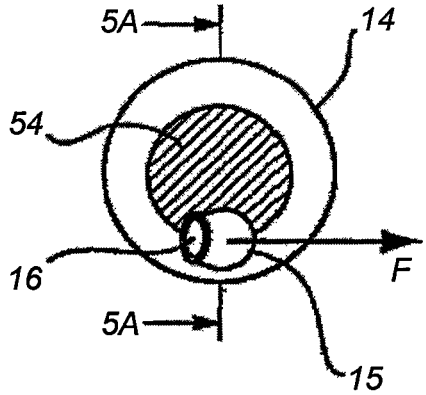

FIG. 5(*a*) is a partially longitudinally cross sectional schematic (side) view of a spray nozzle 10 showing a fourth embodiment of the present invention and FIG. 5(*b*) is a front view of the same. FIG. 5(*a*) corresponds to a cross-section is taken along the line 5A-5A of FIG. 5(*b*).

In this embodiment, the rotor 14 has a brush 54 disposed on and projecting from the distal end thereof. As the rotor 14 is rotated by the counter force F of the ejection of the pressurized air, the brush 54 rotates about the axis of rotation to physically clean up the surface to be blown in the direction of rotation. Also, as the brush 54 is urged in the radial direction by the expanding and rotatably dispersing the pressurized air ejected from the outlet port 16, its cleaning effect involves a combination of blowing in both the direction of rotation and the radial direction of the pressurized air.

Accordingly, when the spray apparatus 30 is used as a dust blower, its spray nozzle 10 of this embodiment can eject a jet of the pressurized air with the brush 54 rotating to physically sweep and move dusts stuck up to the surface to be blown and thus blow away the removed dusts.

Various methods of mounting the brush 54 on the rotor 14 may be employed. As shown, the brush 54 is located closer to the axis of rotation (AX) than the outlet port 16 and can thus prevent the pressurized air ejected from the outlet port 16 from flowing towards the axis of rotation (towards the center) and permit the dusts accumulated across the extension of the axis of rotation to be blown by the surrounding jet of the pressurized air ejected from the outlet port 16, whereby the advantage of the present invention for lifting and removing the dusts will be enhanced.

The brush 54 may be mounted to the circumferential side of the rotor 14, but not limited to its mounting on the distal end of the rotor 14 as shown in the drawing, and projected at the distal end outwardly of the outlet port 16.

Figure 6:
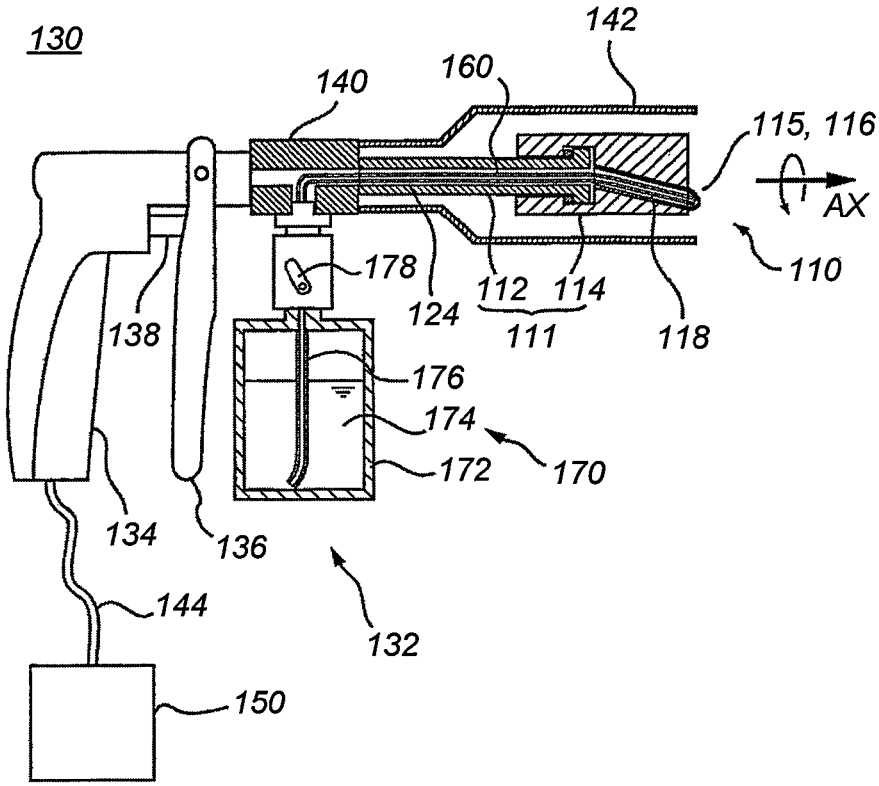
FIG. 6 is a partially longitudinally cross sectional schematic (side) view of a spray apparatus equipped at the distal end with a spray nozzle in accordance with an embodiment of the present technique.

FIG. 6 is a partial sectional schematic view (side view) of a spray nozzle 110, and a spray apparatus 130 including the spray nozzle 110 at the tip end side (right side in the figure) in accordance with one embodiment. The spray nozzle 110, a joint 140 to which the spray nozzle 110 is connected, a cover 142, a sub-medium container 172, and a guide (introduction) tube 176 are shown in a vertical sectional view taken along a vertical section passing the rotary shaft (AX).

Figure 7A:
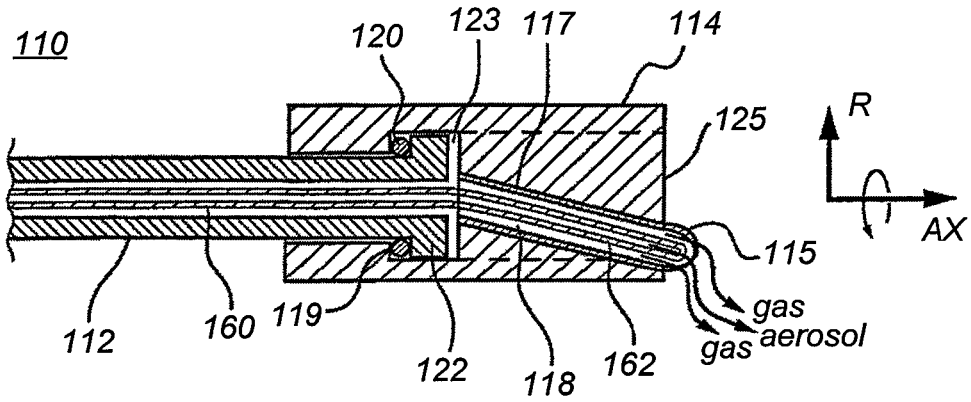
FIG. 7(*a*) is a side view of the spray nozzle taken across line 7A-7A of FIG. 7(*b*) in accordance with an embodiment of the present technique.
Figure 7B:
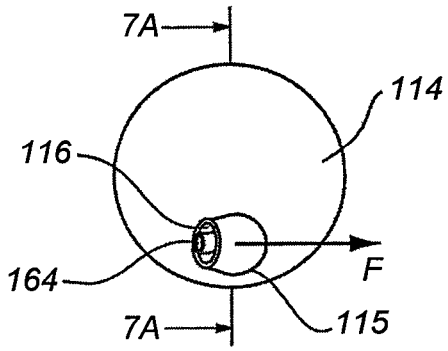
Figure 7C:
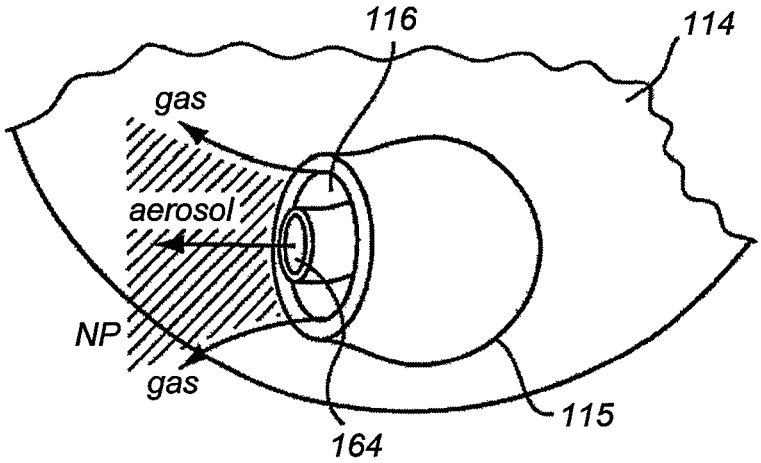

FIG. 7(*a*) is a partial vertical sectional schematic view (side view) of the spray nozzle 110 according to the embodiment. The base end side (left side in the figure) of the fixed outer tube 112 is omitted in the figure. FIG. 7(*b*) is a front view of the spray nozzle 110, wherein FIG. 7(*a*) corresponds to a cross-section taken across line 7A-7A. FIG. 7(*c*) is a partial expanded view of FIG. 7(*b*).

The spray apparatus 130 of the invention sprays a pressurized gas with force from the tip end of a revolving rotor 114 to form a negative pressure, and, thereby, sub-medium 174 such as liquid and granular solids may be sucked from a sub-medium container 172, mixed with the pressurized gas, and sprayed while rotating and diffusing. In this embodiment, specifically, the sub-medium 174 is used as a detergent, and it is formed into aerosol by the spraying pressure of the pressurized gas, and is blown against the cleaning surface to obtain a cleaning power, and thus the spray apparatus 130 is used as a cleaning spray.

The spray apparatus 130 generally includes a spray gun 132 having a spray nozzle 110 and a cover 142, a pressurized gas source 150 containing the pressurized gas (not shown), and a sub-medium supply source 170 containing the sub-medium 174.

The spray gun 132 includes a gun main body 134 having a passage for pressurized gas in its interior, a joint 140, a lever 136, a valve main body 138 communicating between the passage and the pressurized gas source 150 by means of the lever 136, the spray nozzle 110 connected to the tip end of the joint 140, and a trumpet-shaped or horn-shaped cover 142 for protecting the spray nozzle 110. A specific structure of the spray nozzle 110 is described below. The gun main body 134 and the pressurized gas source 150 are connected by way of a flexible tube 144.

In this configuration, when the user holds the lever 136, the valve body 138 opens the passage, and the pressurized gas contained in the pressurized gas source 150 is sprayed from the tip end of the spray nozzle 110 by way of the joint 140. When the user releases the lever 36, the passage from the pressurized gas source 150 to the joint 140 is closed by the valve body 138, and the flow of the pressurized gas is stopped.

The pressurized gas is usually air compressed to a pressure of several to tens of units of Mpa. Inert gas, such as nitrogen or carbon dioxide, or alternative chlorofluorocarbons may be used. By opening the valve body 138, the pressurized gas is decompressed, and is blown out from the outlet port 116 of the spray nozzle 110 at spraying pressure higher than atmospheric pressure but less than about 1 MPa.

The sub-medium 174, aside from the detergent used in the preferred embodiment, may include granular materials such as blasting material, or powder or liquid paint may be used.

The sub-medium 174 contained in the sub-medium container 172 at atmospheric pressure is guided into the spray nozzle 110 through a guide tube 176, and is sprayed from the tip end of the nozzle. The guide tube 176 is provided with a changeover valve 178 for opening and closing the passage from the sub-medium container 172 to the spray nozzle 110. The user manipulates the changeover valve 178, and selects the operation mode, whether to spray the pressurized gas only from the tip end of the spray nozzle 110, or to mix with the sub-medium 174 to spray.

The spray nozzle 110 of the invention has an inner/outer double structure with an outer tube and an inner tube, and the sub-medium 174 is sprayed from the inner tube, and the pressurized gas is sprayed from between the outside of the inner tube and the inside of the outer tube.

The outer tube 111 is composed of a fixed outer tube 112 fixed on the spray gun 132, and a rotor 114 rotatably mounted on the tip end thereof. The rotor 114 is made of a hard material, and a passage 118 communicating with the fixed outer tube 112 is provided in the inside, and a series of passage is formed together with the fixed outer tube 112. At the nozzle tip 115, which corresponds to the tip end of the rotor 114, the outlet port 116 is formed to open toward a direction crossing a direction of a rotary shaft (AX) and a radial direction (R), at a position offset from the rotary shaft of the rotor in said radial direction.

In this spray nozzle 110, when the base end of the fixed outer tube and the joint 140 are connected air-tightly, the pressurized gas source 150 and the through-hole communicate with each other, and therefore by the opening operation of the valve body 138, the pressurized gas is sprayed from the tip end of the passage, and its reaction is applied to the nozzle end portion, and thereby the rotor revolves about the rotating axis (AX).

On the other hand, the inner tube 160 may include a flexible tube, or in a way similar to the outer tube 111, it may be composed of a fixed inner tube fixed on the spray gun 132, and a rotating inner tube rotatably connected thereto.

In the former case corresponding to this preferred embodiment, the base end side (left side in the diagram) of the inner tube 160 is inserted into the fixed outer tube 112, and the tip end side (right side in the diagram) communicates with the outlet port 16. The base end of the inner tube 160 communicates with the sub-medium container 172. An opening end 164 at the tip end side of the inner tube 160 may be slightly projected from the outlet port 116 as shown in FIGS. 7 (*b*) and (c), but may be disposed inside of the passage 118 of the rotor 114, or may be fixed near the tip end of the fixed outer tube 112. When the pressurized gas is sprayed from the outlet port 116, a negative-pressure zone (NP) is formed not only around the outlet port 116, but also from the inside of the passage 18 toward the tip end of the fixed outer tube 112, so that the sub-medium 174 can be sucked out from the sub-medium container 172 wherever the opening end 164 may be disposed.

In the latter case corresponding to a third preferred embodiment mentioned below, the fixed inner tube for composing the base end side of the inner tube 60 is inserted into the fixed outer tube 12, and the rotating inner tube 166 for composing the tip end side is disposed inside the passage 118. The opening end at the tip end side of the rotating inner tube 160 may be slightly projected from the outlet port 16, or may be disposed inside the passage 118. By connecting the fixed inner tube 166 and rotating inner tube 160 rotatably, the rotating inner tube is rotatable, follows the rotor 114, and also communicates with the sub-medium container 172 by way of the fixed inner tube 166. Therefore, by spraying the pressurized gas from the outlet port 116, a negative-pressure zone (NP) is formed near the outlet port 116 and inside the passage 118, and from the sub-medium container 172, the sub-medium 174 is sucked out from the fixed inner tube and the rotating inner tube, and it is mixed with the pressurized gas, and is sprayed from the outlet port 116.

Thus, by forming the tip end side of the passage for passing pressurized gas at high pressure by using a rotor made of hard material, when spraying the pressurized gas, the nozzle end does not move unconstrained/unruly, or if the spray apparatus 130 is used in low temperature environment, the nozzle is free from hardening or closing, and the sub-medium 172 can be sprayed stably.

In such an embodiment, the base end side (left side in the diagram) of the inner tube 160 communicates with the sub-medium container 172 by way of the changeover valve 178, and the middle portion is inserted into the fixed outer tube 112, and the tip end portion (inner tube tip end portion) 162 (right side in the diagram) is inserted into the passage 118 provided inside of the rotor 114.

The base end of the fixed outer tube 112 for forming the outer tube 111 communicates with the pressurized gas source 150 by way of the joint 140.

The nozzle tip 115 positioned at the tip end (right side in the diagram) of the passage 118 communicating with the fixed outer tube 112 is formed at a position offset from the rotational axis (AX) of the rotor 114 in the radial (R) direction. The nozzle tip 115 is also provided with the outlet port 116 opened in a direction intersecting with both rotational axis direction and the radial direction. In other words, the normal direction of the opening side of the outlet port 116, that is, the spray direction has components of rotating direction about the rotational axis. In such configuration, by manipulating the lever 136, when the passage of the pressurized gas is opened, and the pressurized gas is sprayed from the outlet port 116, as shown in FIG. 7 (*b*), the nozzle tip 115 receives the spray reaction force F, and the integrated rotor 114 rotates about the rotational axis. In the illustrated spray nozzle 110, since the outlet port 116 is directed in the intermediate direction between the rotational axis straight-forward direction and the rotating direction about the rotational axis, when the pressurized gas is sprayed from the outlet port 116, the rotor 114 rotates in counterclockwise direction as seen from the rotational axis direction together with the outlet port 116, and the outlet port 116 moves on the circumference of a circle with the radius corresponding to the offset width from the rotational axis of the nozzle tip 115.

As shown in FIG. 7 (*c*), the opening end 164 at the tip end side of the inner tube 160 is slightly projected from the outlet port 116, and is disposed in a negative-pressure zone (NP), which is formed when the pressurized gas is sprayed from the outlet port 116. Therefore, by spraying the pressurized gas, the sub-medium 174 is sucked by the negative-pressure zone (NP), and flows out from the opening end 164. The negative-pressure zone (NP) is formed, as shown in the diagram, not only near the outside of the outlet port 116, but also in the passage 118. However, near the outside of the outlet port 116, the pressurized gas is sprayed from the outlet port 116 to be expanded most abruptly so that the pressure around there becomes low. Therefore, a strong sucking force can be obtained for the sub-medium 174. By such abrupt expansion of pressurized gas, the sub-medium 174 flowing out from the opening end 164 is dispersed into fine substances that form an aerosol. Therefore, according to the spray nozzle 110 of the preferred embodiment using the detergent as the sub-medium 174, the aerosol of the detergent can be blown to the surface to be cleaned together with the jet of the pressurized gas. The mixed gas of detergent (aerosol) and pressurized gas is sprayed by the revolving rotor 114, and is hence rotated and diffused, and the pressure wave of the pressurized gas is amplified, and the gas can be sprayed widely and uniformly on a broad surface to be cleaned at higher spraying pressure.

The fixed outer tube 112 is a tube body fixed and provided on the spray gun 132. The connection mode of the base end of the fixed outer tube 112 and the joint 140 is not particularly specified, but preferably they should be mutually engaged by forming male threads on the outer circumference of the base end side of the fixed outer tube 112 and forming corresponding female threads at the tip end side of the joint 140. The central line shape and the sectional shape of the fixed outer tube 112 are not particularly specified, and the spray nozzle 110 of the preferred embodiment shows the fixed outer tube 112, which is circular in section and straight in the central line shape.

In the preferred embodiment, the center in the section of the fixed outer tube 112 and the rotating axis (AX) of the rotor 114 coincide with each other. However, as far as the rotor 114 is rotatable on the fixed outer tube 112, and the sprayed pressurized gas does not leak out significantly from the gap between the fixed outer tube 112 and rotor 114, the rotational axis of the rotor 114 need not necessarily coincide with the center of the section of the fixed outer tube 112, and if the rotational axis is at an eccentric position from the center of the fixed outer tube 112, the extending direction of the tip end of the fixed outer tube 112 may not coincide with the rotational axis.

The fixed outer tube 112 and the rotor 114 forming the passage of pressurized gas are both made of hard materials, and spraying of pressurized gas does not deform these materials significantly. Specifically, hard plastic materials and metal materials can be used, and from the viewpoint of resistance to pressure and durability, the fixed outer tube 112 is preferably made of metal material, such as stainless steel etc., and from the viewpoint of smaller moment of inertia and smooth rotation, the rotor 114 is preferably made of hard plastic materials such as polyurethane etc., containing plasticizer added to them.

In the spray nozzle 110 of the preferred embodiment, the fixed outer tube 112 and rotor 114 are connected by way of a bearing 120 such as rolling bearing or sliding bearing.

A flange 122 is formed at the tip end portion of the fixed outer tube 112. On the other hand, inside the base end side of the rotor 114, a compartment 123 is provided for accommodating the flange 22 and the bearing 20. The base end side of the chamber 123 has a thick portion 119 (e.g., projecting convex) so as to be smaller in diameter than the flange 122 and large in diameter than the fixed outer tube 112. By inserting the bearing 120 between the flange 122 and the thick portion 119, the fixed outer tube 112 and the rotor 114 rotatably connected on the rotational axis in the center of the section of the fixed outer tube 112.

In the spray nozzle 110 of the preferred embodiment, by burying a pipe 117 in the rotor 114, the passage 118 is formed. The pipe 117 rotating axially together with the rotor 114 coincides or nearly coincides with the rotational axis (AX) at the base end, and is opened to the chamber 123, and thereby communicates with the fixed outer tube 112. The tip end of the pipe 117 is at an offset position as specified from the rotational axis, and is bent so that the direction of the outlet port 116 at the opening end may have a rotating direction component with the specified rotating direction component, and thereby the nozzle tip 115 is formed.

The material and shape of the pipe 117 are not particularly specified, and, for example, a cylindrical tube of hard plastic material may be used. The pipe 117 may be a straight tube being crossed obliquely to the rotational axis as shown in the diagram, or being curved or bent in the central line shape.

The inner tube 160 of the passage of the sub-medium 174 is loaded only with a high atmospheric pressure of the reserve pressure of the sub-medium container 172. Therefore, it is made of a soft material in the preferred embodiment. In particular, in order that the inner tube tip end portion 162 of the inner tube 160 inserted in the passage 118 of the rotor 114 may follow the rotor 114 and revolve smoothly, the inner tube 160 is preferably made of flexible tube made of flexible synthetic resin, such as nylon, polytetrafluoroethylene, polyurethane, or polypropylene.

Since the inner tube 160 is protected by the outer tube 111 formed of fixed outer tube 112 and rotor 114, and if a flexible tube is used in the inner tube 160, the inner tube tip end 162 does not move unconstrained/unruly, and hence is not worn by colliding against the cover 142.

The inner tube 160 may be formed as a series of flexible tubes from the base end to the tip end, or the portion inserted into the inside of the fixed outer tube 112 may be formed as a fixed inner tube formed of hard plastic or metal, or a flexible tube may be fitted to the tip end so as to be revolving.

The spray nozzle 110 of the preferred embodiment may be manufactured in the following procedure.

The tip end of a metal tube is expanded, and a flange 122 is formed, and a fixed outer tube 112 is manufactured. On the other hand, a cylindrical rotor 114 blanking the base end side in small diameter and the tip end side in large diameter is manufactured by using a hard plastic material. The small diameter at the base end side of the rotor 114 coincides with the inside diameter of the above convex portion 119, and the large diameter of the tip end side coincides with the inside diameter of the chamber 123 as indicated by broken line in FIG. 7 (*a*).

The fixed outer tube 112 mounted on the circumference of the bearing 120 is inserted into the rotor 114 from the tip end side blanked in a larger diameter than the rotor 114. The inside diameter of the thick portion 119 of the rotor 114 is smaller than the diameter of the flange 122 of the fixed outer tube 112, and the flange 122 acts as stopper, and the thick portion 119 and the flange 122 contact with each other by way of the bearing 120.

The inner tube 160 of a flexible tube having a smaller outside diameter than the inside diameter of the fixed inner tube 112 is inserted into the fixed outer tube 112 from the base end side or tip end side, and a part of the inner tube tip end portion 162 is projected from the rotor 114.

A pipe 117 is formed by bending so that the base end may be opposite to the fixed outer tube 112 and that the tip end may come to the specified offset position from the rotational axis (AX), and is fixed temporarily from the tip end side of the blanked rotor 114, and the tip end portion of the inner tube 160 is projected from the outlet port 16 at the tip end side opening of the pipe 117. At this time, the temporarily fixed pipe 117 is directed so that the outlet port 16 may be formed at a rotating direction portion from the desired rotational axis component.

By spraying a fused resin material 125 on the periphery of the temporarily fixed pipe 117, the rotor 114 is fixed, and by machining the tip end side of the rotor 114, the chamber 123 is formed inside of the rotor 114. The base end side of the chamber 123 is hermetically sealed by the bearing 120. A resin material 125 sprayed to the base end side of the rotor 114 may be either same material or different material of the rotor 114.

The tip end portion of the inner tube 160 projecting from the outlet port 16 is cut to a specified size of the projecting length. The projecting length is adjusted from the viewpoint of whether the opening end 164 of the inner tube 160 is disposed or not within the negative-pressure zone (NP) formed at the time of spraying of pressurized gas from the outlet port 16 and whether the sub-medium 174 is smoothly sucked or not.

Thus, the fixed outer tube 112 and rotor 114 are manufactured by using hard materials, and both are connected by a bearing 120 to form an outer tube 111, so that the components are not deformed by the spraying pressure of the pressurized gas, and the internal loss of spraying energy of pressurized gas is suppressed.

The rotor 114 is formed in a columnar shape around the rotational axis, and the nozzle tip 115 and outlet port 116 are formed in a shape settling within the plane of the tip end side end face, and the rotating main body 114 is free from any portion projecting in the radial direction, and the spray apparatus 130 of the invention can be used safely.

In the spray apparatus 130 of the invention, further, considering the safety of the user and others, as shown in FIG. 6, a trumpet-like cover 142 may be provided in the radial sideway direction of the rotor 114. Since the cover 142 used in the invention does not contact with the rotor 114, the inner surface is not contaminated, or the rotor 114 is not worn. Therefore, as far as not contacting with the rotor 114, the shape of the cover 142 is not particularly specified, but to suppress excessive rotation and diffusion of the pressurized gas sprayed from the revolving outlet port 16, the tip end of the cover 142 may be projected from the outlet port 116 like an awning to the tip end side. The cover 142 is attached to the joint 140, for example, of the gun main body 134. The cover 142 may be detachable from the gun main body 134.

In the invention, as mentioned above, the pipe 117 is buried in the rotor 114, and the passage 118 is formed. Besides, by piercing a hole in the solid rotor 114, the passage 118 may be provided. Moreover, the rotor 114 having the passage 118 in the inside is split into halves, and the fixed outer tube 112 and the bearing 120 are fitted into the rotor 114, and the halves of the rotor 114 may be joined and bonded integrally.

Besides, in the invention, the pipe 117 may be exposed outside without being buried in the rotor 114. That is, by offsetting the tip end in the radial (R) direction form the rotational axis (AX), the pipe 117 formed to have a rotational direction component at least in the opening direction is composed of a hard material, and it maybe used as the rotor 114. When mounting such rotor 114 rotatably on the tip end of the fixed outer tube 112, the both may be bonded directly to be slidable, for example, by mutually fitting without using bearing, or the both may be integrated by way of other rotational axis member not shown.

Figure 8A:
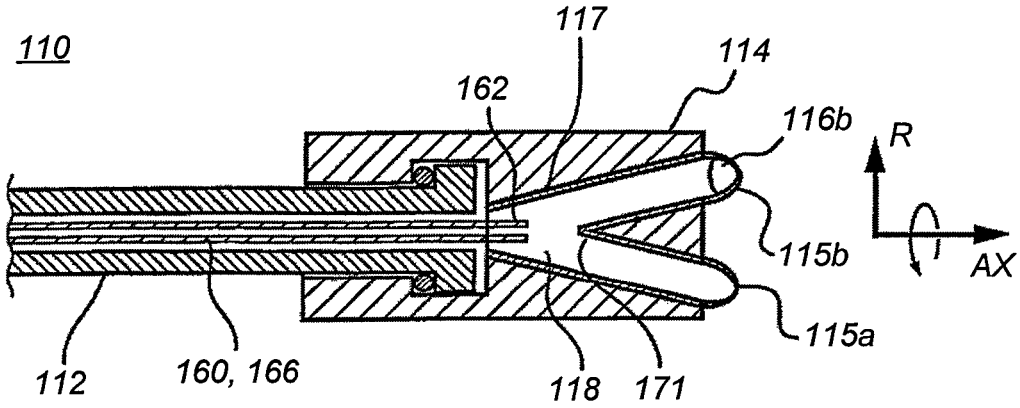
FIG. 8(*a*) is a side view of the spray nozzle taken across line 8A-8A of FIG. 8(*b*) in accordance with an embodiment of the present technique.
Figure 8B:
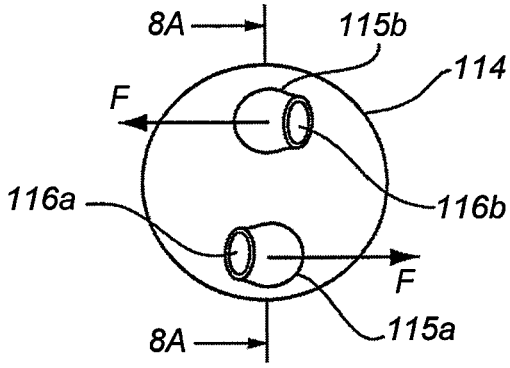

FIG. 8 (*a*) a partial longitudinal sectional schematic view (side view) of the tip end portion of spray nozzle 110 of the second preferred embodiment of the invention, and FIG. 8 (*b*) is its front view. FIG. 8(*a*) corresponds to a cross-section taken across line 8A-8A in FIG. 8 (*b*).

In the preferred embodiment, the pipe 117 buried in the rotor 114 is divided into two branches toward the tip end (right side in the diagram), and each tip end is bent and formed, and nozzle tips 115*a*, 115*b* are provided, and outlet ports 116*a*, 116*b* are opened and formed. The inner tube 160 (fixed inner tube 166) is inserted into the fixed outer tube 112 at its base end side, and the tip end side projects in the direction of the nozzle tip end from the fixed outer tube 112, and is inserted into the passage 118. However, the inner tube tip end portion 162 does not reach up to the bifurcate portion 171, and the inner tube 160 and the pipe 117 do not interfere with each other if the pipe 117 rotates around the rotational axis (AX) together with the rotor 114.

The fixed inner tube 166 communicates with the sub-medium container 172 at the base end side, and a passage of sub-medium 174 is formed.

The fixed inner tube 166 can be inserted and fixed in the fixed outer tube 112, and its material is not particularly specified as far as corrosion or abrasion may not take place inside due to circulation of the sub-medium 174, and hard plastics and metals may be used favorably.

Pressurized gas flows toward the tip end of the spray nozzle 110 between the fixed inner tube 166 and the fixed outer tube 112, and is branched into two direction by the bifurcate pipe 117, and sprayed from the outlet ports 116*a*, 116*b*, and a negative-pressure zone is formed near the outside of the outlet ports 116*a*, 116*b* and inside the passage 118, and the inner tube tip end portion 162 is disposed in this negative-pressure zone. Therefore, the sub-medium 174 is sucked out from the fixed inner tube 166, and is mixed with the pressurized gas in the passage 118, and is rotatory-sprayed from the spray ports 116*a*, 116*b*.

The inner tube tip end portion 162 of the fixed inner tube 166 is inserted inside the though-hole 118 as in the preferred embodiment, or may be disposed at a position flush with the tip end of the fixed outer tube 112 or inside of the fixed outer tube 112 as far as the sub-medium 174 can be sucked out from the inner tube 160 by the sucking effect in the negative-pressure zone. However, since the negative-pressure zone is at the lowest pressure near the exist of the outlet ports 116*a*, 116*b*, the inner tube tip end 162 is preferred to be disposed closely to the outlet ports 116*a*, 116*a* as much as possible, and more preferably inside of the passage 118 and behind and near the bifurcate portion 171.

In the diagram, the lower half and upper half of the rotor 114 are formed symmetrically about the center of rotational axis (AX). Therefore, the two nozzle tips 115*a*, 115*b*, the outlet ports 116*a*, 116*b*, and opening ends 164*a*, 164*b* are disposed symmetrically about the rotational axis. The lower outlet port 116*a* has an opening component in rotation reverse direction (left direction in the diagram) of the direction intersecting with the offset direction (lower direction in (b)) from the rotational axis of the rotational axis direction (front direction on sheet of paper in (b)). Due to necessity of spraying the sub-medium 174 in the rotational axis direction, the outlet port 116*a* has an opening portion in the rotational axis direction. Therefore, the outlet port 116*b* is opened in the intermediate direction between the rotational axis direction and the rotation reverse direction. Similarly, the upper outlet port 116*b* is opened toward the rotational axis direction and the intermediate direction toward the rotation reverse direction (right direction in (b)). In other words, the two outlet ports 116*a*, 116*b* are opened and formed at the tip end of the rotor 114 having a same rotating direction component about the rotational axis.

Hence, when the pressurized gas supplied through the passage 118 inside the fixed outer tube 112 is sprayed from the outlet ports 116*a*, 116*b*, the reaction force f applied to the rotor 114 is the common rotating direction as seen from the arrow in diagram (b), specifically counterclockwise direction as seen from the rotational axis direction.

Thus, a plurality of outlet ports 116*a*, 116*b* are disposed at symmetrical positions around the rotational axis, and directed in one same rotating direction, and the components in the rotating direction out of the spray reaction force of the pressurized gas are summed up, and the components in the radial direction are canceled, and the rotor 114 is not eccentric in the radial direction to the fixed outer tube 112 or does not swing or oscillate, and thereby rotates favorable around the rotational axis.

Besides, by forming a plurality of opening ends 164*a*, 164*b* of the inner tube, the sub-medium 174 is dispersed and sprayed more uniformly.

In the invention, facing of the plurality of spray ports in a same rotating direction means that the pressurized gas sprayed from any spray port does not interfere with the pressurized gas sprayed from other spray port to cancel the reaction forces acting on the rotor 114, but does not mean complete coincidence of the opening directions. The same holds true with the symmetrical positions of the plurality of spray ports around the rotational axis, and it is enough if the plurality of spray ports are disposed in good balance around the rotational axis.

In the preferred embodiment, one pipe 117 is branched, and the plurality of outlet ports 116*a*, 116*b* are disposed at the tip ends, but in the invention, not limited to this example, a plurality of tubes 117 each having one spray port may be connected directly to the tip end of one or a plurality of fixed outer tubes 112, or disposed indirectly or rotatably by way of other connection member. Besides, a plurality of independent passages 118 may be machined inside the solid rotor, and the outlet ports 116*a*, 116*b* may be formed at each tip end in the opening direction as shown in the preferred embodiment.

Figure 9A:
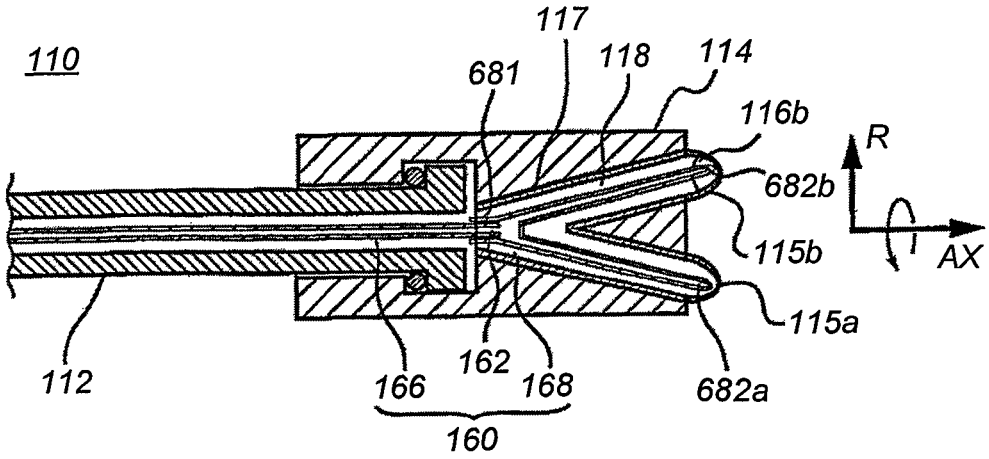
FIG. 9(*a*) is a side view of the spray nozzle taken across line 9A-9A of FIG. 9(*b*) in accordance with an embodiment of the present technique.
Figure 9B:
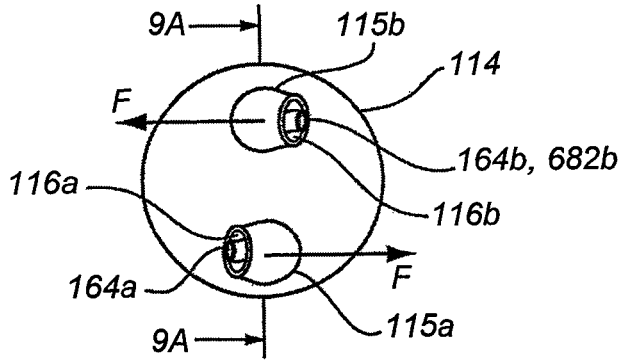

FIG. 9 (*a*) is a partial longitudinal sectional schematic view (side view) of the tip end portion of spray nozzle 110 of the third preferred embodiment of the invention, and FIG. 9 (*b*) is its front view. FIG. 9 (*a*) corresponds to a cross-section taken across line 9A-9A of FIG. 9 (*b*).

In the illustrated embodiment, in a manner similar to one or more embodiments discussed above (see FIG. 8), the pipe 117 divided into two sections is buried in the rotor 114, and passages 118 are formed, but different from the second preferred embodiment, the bifurcate rotating inner tube 168 is inserted and fixed in the passages 118, and is rotatably connected to the fixed inner tube 166.

The rotating inner tube 168 has its base end 681 rotatably fitted to the inner tube tip end portion 162 of the fixed inner tube 66. The tip ends 682*a*, 682*b* of the bifurcate rotating inner tube 168 are inserted into the bifurcate passages 118 respectively.

The position of the tip ends 682*a*, 682*b* may be either inside of the passages 118, or outside of the nozzle tip end side projected from the outlet ports 116*a*, 116*b*. In this preferred embodiment, as shown in FIG. 9 (*b*), the tip ends 682*a*, 682*b* project respectively from the outlet ports 116*a*, 116*b* of the rotor 114, and the opening end 164*a* of the tip end 682*a* and the opening end 164*b* of the tip end 682*b* are disposed in the negative-pressure zone formed near the outside of the outlet ports 116*a*, 116*b*.

The rotating inner tube 168 is made of hard plastics, metals, or other hard materials, and is connected to the inner tube tip end portion 162 to keep communication with the fixed inner tube 166, and rotates about the rotational axis (AX) by following up the rotation of the rotor 114 due to spraying of pressurized gas. In this state, when the pressurized gas is sprayed from the outlet ports 116*a*, 116*b*, a negative pressure is formed near the opening ends 164*a*, 164*b* of the rotating inner tube 168, ad the sub-medium 174 is sucked in through the rotating inner tube 168 and the fixed inner tube 166, and is mixed with the pressurized gas, and is rotated and sprayed.

Preferably, the base end 681 of the rotating inner tube 168 and the inner tube tip end portion 162 should be connected air-tightly, but by forming the base end 681 in a wider diameter and covering and fitting the inner tube tip end portion 162, the sub-medium 174 will not escape the inner tube tip end portion 162 to leak out to the passages 118.

The rotating inner tube 168 of the preferred embodiment is configured so that its base end 681 may slide and rotate about the inner tube tip end portion 162 of the fixed inner tube 166 as rotational axis. Alternatively, a core member as rotational axis of the rotating inner tube 168 may be provided by projecting from the fixed inner tube 166 to the tip end side, and the rotating inner tube 168 may be mounted on such core member.

Figure 10A:
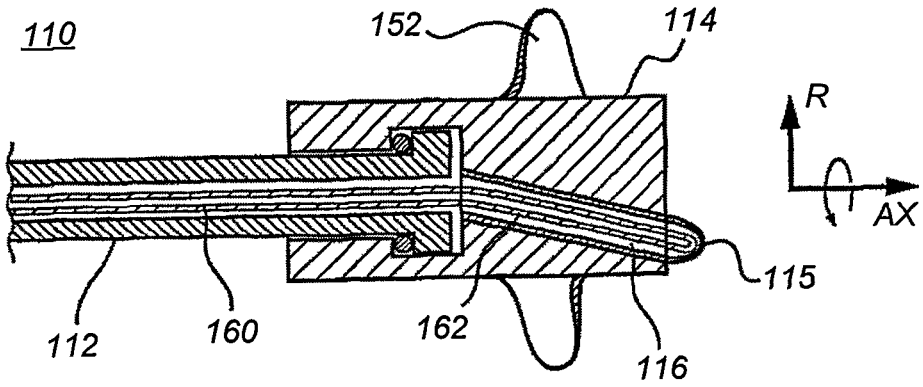
FIG. 10(*a*) is a side view of the spray nozzle taken across line 10A-10A of FIG. 10(*b*) in accordance with an embodiment of the present technique.
Figure 10B:
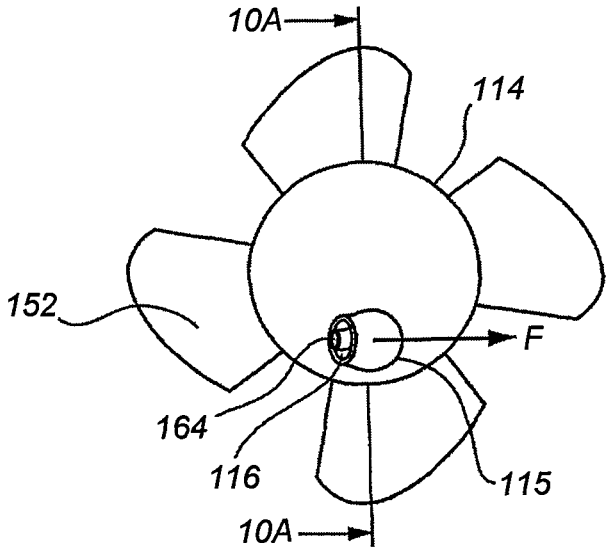

FIG. 10 (*a*) is a partial longitudinal sectional schematic view (side view) of the tip end portion of spray nozzle 10 of the fourth preferred embodiment of the invention, and FIG. 10 (*b*) is its front view. FIG. 10 (*a*) corresponds to a cross-section taken across line 10A-10A of FIG. 10 (*b*).

In the preferred embodiment, the rotor 114 is provided with an axial flow fan (fan) 152 on its circumference, and when the rotor 114 is rotated by spray of pressurized gas, the fan 152 generates an air stream toward the direction of rotational axis (AX). Accordingly, in the spray nozzle 110 of the preferred embodiment, if the pressurized gas spray from the outlet port 116 is excessive in the radial (R) direction, and insufficient in the rotational axis (AX) direction, since the rotor 114 is provided with the fan 152, an axial flow is generated, and by its reaction force, the rotation of the rotor 114 is suppressed, and together with the axial flow, a sufficient spraying force is obtained in the direction of rotational axis. That is, by suppressing excessive rotation of the rotor 114 by the fan 152, diffusion of pressurized gas and sub-medium 174 is suppressed, and the spraying force in the direction of rotational axis is enhanced. From such viewpoint, therefore, by only providing with rotation resisting means for suppressing the rotation of the rotor 114, the spraying force in the direction of rotational axis can be adjusted, and moreover by providing the rotor 114 with the axial flow fan as in the preferred embodiment, the rotation resistance occurring in the rotor 114 is not spent as a mere energy loss, but is converted into a jet flow in the direction of rotational axis, thereby assisting the spraying force of the pressurized gas. In a modified example of the spray nozzle 110 of the preferred embodiment, the fan 152 may be detachably installed in the rotor 114. As a result, depending on the application of the spray apparatus 130, the spraying force in the direction of rotational axis may be increased or decreased as desired. From the same viewpoint, moreover, the deflection angle of the fan 152 or the mounting angle on the rotor 114 may be variable and adjustable.

Figure 11A:
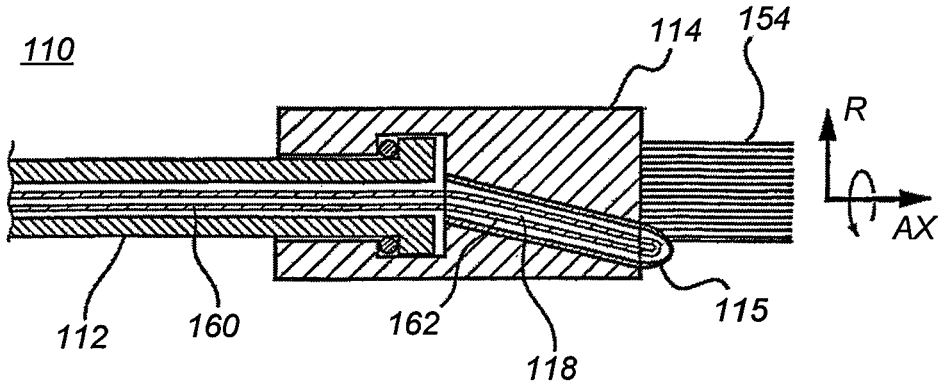
FIG. 11(*a*) is a side view of the spray nozzle taken across line 11A-11A of FIG. 11(*b*) in accordance with an embodiment of the present technique.
Figure 11B:
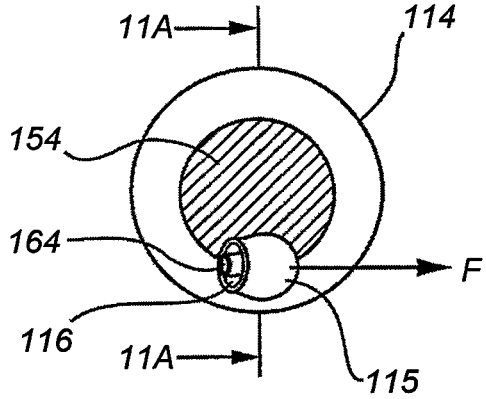

FIG. 11 (*a*) a partial longitudinal sectional schematic view (side view) of the tip end portion of spray nozzle 10 of the fifth preferred embodiment of the invention, and FIG. 11 (*b*) is its front view. FIG. 11 (*a*) corresponds to a cross-section taken across line 11A-11A of FIG. 6 (*b*). In the preferred embodiment, the rotor 114 is provided with a brush 154 projecting from its tip end. Therefore, when the rotor 114 is rotated by the spray reaction force F of the pressurized gas, the brush 154 also rotates about the rotational axis, and the surface to be sprayed can be physically wiped in the rotating direction by using the brush 154. The brush 154 is also bent in the radial direction by expansion and rotating diffusion of pressurized gas sprayed from the rotating outlet port 116, and the surface to be sprayed is wiped by the brush 154 in both rotating direction and radial direction. Therefore, when the spray apparatus 130 is used as a cleaning spray, by using the spray nozzle 110 of the preferred embodiment, the aerosol of the detergent can be sprayed to the surface to be sprayed, and the sticking dirt can be physically wiped off by the brush 154 in longitudinal and lateral directions, and can be removed.

The brush 154 can be attached to the rotor 114 in various modes. As shown in the drawing, by installing at the central side of rotational axis (AX) from the outlet port 116, the pressurized gas sprayed from the outlet port 116 is prevented from flowing into the rotational axis side (central direction), and the detergent can be sprayed to the object to be sprayed (the dirt) disposed on the extension of rotational axis by enclosing uniformly from all directions. To the contrary, by installing the brush 154 at the outer side from the outlet port 116, the pressurized gas sprayed from the outlet port 116 is guided to the axial center side, and the detergent can be concentrated on the object of spray. The brush 154 may be planted on the tip end side of the rotor 114, or may be provided on the circumference of the rotor 114, and the tip end of the brush 154 may be projected from the outlet port 116.

In accordance with the discussion provided above, embodiments of the spray (air blow) nozzle of the present invention may include a combination of the following:

(1) An air blow nozzle for ejecting and dispersing a jet of pressurized air stored in a pressurized air supply source from its blow outlet which is rotating, comprising: a stationary tube communicated at the proximal end to the pressurized air supply source; and a rotary member made of a rigid material, having an air passage provided therein for communicating with the stationary tube, and arranged rotatably in relation to the distal end of the stationary tube, wherein the blow outlet is provided at a location, which is offset distanced along a radial direction from the axis of rotation of the rotary member, in the distal end of the rotary member and its opening is contemplated to face a direction which intersects both the axis of rotation and the radial direction;

(2) The air blow nozzle defined in (1), wherein the stationary tube and the rotary member are joined to each other by a bearing;

(3) The air blow nozzle defined in (1) or (2), wherein the rotary member has two or more blow outlets provided therein for communicating respectively with the stationary tube and located symmetry with respect to the axis of rotation while the blow outlets are opened in the direction of rotation about the axis of rotation;

(4) The air blow nozzle defined in any one of (1) to (3), wherein the rotary member has a fan provided thereon for producing an axial flow along the axis of rotation when the rotary member rotates;

(5) The air blow nozzle defined in any one of (1) to (4), wherein the rotary member has a brush provided projectingly on the distal end thereof.

Further, in accordance with the discussion provided above, embodiments of the spray (air blow) apparatus of the present invention may include a combination of the following:

(6) An air blow apparatus comprising: (A) a pressurized air supply source where pressurized air is stored; (B) an air blow nozzle including a stationary tube communicated at the proximal end to the pressurized air supply source, and a rotary member made of a rigid material, having an air passage provided therein for communicating with the stationary tube, and arranged rotatably in relation to the distal end of the stationary tube, wherein the blow outlet is provided at a location, which is offset distanced along a radial direction from the axis of rotation of the rotary member, in the distal end of the rotary member and its opening is contemplated to face a direction which intersects both the axis of rotation and the radial direction; and (C) a valve for closing and opening the passage of the pressurized air between the pressurized air supply source and the stationary tube, wherein the rotary member is turned about the axis of rotation by the ejection of the pressurized air so that the pressured air ejected from the blow outlet can be dispersed.

Further, in accordance with the discussion provided above, embodiments of the spray (air blow) nozzle of the present invention may include a combination of the following:

(7) a spray nozzle which is a nozzle having an inner/outer double structure, with an outer tube and an inner tube inserted into this outer tube, for spraying pressurized gas stored in a pressurized gas supply source from between said inner tube and said outer tube and spraying a sub-medium from said inner tube, the sub-medium comprising liquid, granular solids, or a mixture of the liquid and the granular solids and stored in a supply source of the sub-medium, the spray nozzle having all of characteristics of (a) to (c) as follows: (a) the outer tube has (i) a fixed outer tube, with a base end communicated with the pressurized gas supply source, and has (ii) a rotor made of a hard material, having a through hole inside so as to be communicated with the fixed outer tube, and rotatably fitted to the tip end of the fixed outer tube, and (iii) on the tip end of the rotor, spray ports are formed so as to be opened toward a direction crossing a direction of a rotary shaft and a direction of a diameter, at a position offset from the rotary shaft of the rotor in the diameter direction; (b) the inner tube has flexibility, with the base end side communicated with the supply source of the sub-medium, and the tip end side communicated with the spray ports; and (c) by spraying the pressurized gas from the spray ports, the rotor rotates around the rotary shaft by the spray reaction force, and the sub-medium is sucked from the supply source of the sub-medium through the inner tube, by a negative pressure generated in the vicinity of the spray ports or inside of the through hole, and the sucked sub-medium is mixed with the sprayed pressurized gas and is sprayed from the spray ports.

Further, in accordance with the discussion provided above, embodiments of the spray (air blow) nozzle of the present invention may include a combination of the following:

(8) A spray nozzle which is a nozzle having an inner/outer double structure, with an outer tube and an inner tube inserted into this outer tube, for spraying pressurized gas stored in a pressurized gas supply source from between the inner tube and the outer tube and for spraying a sub-medium from the inner tube, the sub-medium comprising liquid, granular solids, or a mixture of the liquid and the granular solids and stored in a supply source of the sub-medium, the spray nozzle having all of characteristics of (a) to (c) as follows: (a) the outer tube has (i) a fixed outer tube, with a base end communicated with the pressurized gas supply source, and has (ii) a rotor made of a hard material, having a through hole inside so as to be communicated with the fixed outer tube, and rotatably fitted to the tip end of the fixed outer tube, and (iii) on the tip end of the rotor, spray ports are formed so as to be opened toward a direction crossing a direction of a rotary shaft and a direction of a diameter, at a position offset from the rotary shaft of the rotor in the diameter direction; (b) the inner tube has (i) a fixed inner tube inserted into the fixed outer tube, with the base end communicated with the supply source of the sub-medium, and has (ii) a rotary inner tube made of a hard material, with the base end rotatably connected to the tip end of the fixed inner tube inside of the fixed outer tube or inside of the through hole, and the tip end side inserted into the through hole; and (c) by spraying the pressurized gas from the spray ports, the rotor and the rotary inner tube are rotated around the rotary shaft by this spray reaction force, and by a negative pressure generated in the vicinity of the spray ports or inside of the through hole, the sub-medium is sucked from the supply source of the sub-medium through the inner tube, and the sucked sub-medium is mixed with the sprayed pressurized gas and sprayed from the spray ports;

Further, in accordance with the discussion provided above, embodiments of the spray (air blow) nozzle of the present invention may include a combination of the following:

(9) The spray nozzle according to the aforementioned description 7 or 8, wherein the rotor has a plurality of spray ports communicated with the tip end of the fixed outer tube respectively in a rotational symmetry position with respect to the rotary shaft, and the plurality of spray ports are formed toward the same rotational direction around the rotary shaft;

(10) The spray nozzle according to any one of the aforementioned description 7, 8, or 9, wherein an opening end of the inner tube at the tip end side is disposed in a negative-pressure zone formed by spray of said pressurized gas, in the vicinity of the spray ports;

(11) The spray nozzle according to any one of the aforementioned descriptions 1 to 9, wherein an opening end of the inner tube at the tip end side is disposed inside of said through hole;

(12) The spray nozzle according to any one of the aforementioned descriptions 1 to 11, wherein the fixed outer tube and the rotor are connected to each other via a bearing;

(13) The spray nozzle according to any one of claims 1 to 12, wherein the rotor includes a fan for generating an axial flow in the direction of the rotary shaft by rotation of this rotor;

(14) The spray nozzle according to any one of the aforementioned descriptions 1 to 13, wherein the rotor has a brush protruded from the tip end of this rotor.

(15) The present invention provides a spray apparatus comprising: a pressurized gas supply source in which pressurized gas is stored; a sub-medium supply source in which liquid, granular solids or a mixture of the liquid and the granular solids is stored; a spray nozzle of any one of the aforementioned descriptions 1 to 14; and a valve element for shutting off or releasing the pressurized gas flown to the outer tube from the pressurized gas supply source, wherein the pressurized gas and the sub-medium are sprayed in a mixed state.

Further modifications and alternative embodiments of various aspects of the invention will be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as examples of embodiments. Elements and materials may be substituted for those illustrated and described herein, parts and processes may be reversed or omitted, and certain features of the invention may be utilized independently, all as would be apparent to one skilled in the art after having the benefit of this description of the invention. Changes may be made in the elements described herein without departing from the spirit and scope of the invention as described in the following claims. The words "include", "including", and "includes" mean including, but not limited to.

What is claimed is:

1. A spray nozzle, comprising:

a stationary tube in fluid communication with a pressurized air source;

a rotor coupled to the tube, wherein the rotor is in fluid communication with the pressurized air source;

a conduit in fluid communication with the passages of the tube and the rotor, wherein the conduit is rigid and substantially arched or angled such that an outlet of the conduit is offset a radial distance in a radial direction from the rotor axis, wherein pressurized air ejected from the outlet, during use, rotates the conduit, and wherein the conduit that is substantially arched or angled remains substantially unflexed during rotation, wherein pressurized air ejected from the outlet produces directional components of pressurized air to rotate the rotor;

a hand-held actuator coupled to the stationary tube, wherein the hand-held actuator is in fluid communication with the pressurized air source, the hand-held actuator being configured to allow a user to actuate the hand-held actuator and thereby allow air from the pressurized air source to flow into the conduit and be ejected from the outlet; and wherein the spray nozzle is configured to provide pressurized air to a surface to at least partially clean the surface.

2. A spray nozzle cleaning apparatus, comprising:

a first tube in fluid communication with a pressurized air source;

a rotor coupled to the first tube and in fluid communication with the pressurized air source;

a conduit, the conduit in fluid communication with a passage of the first tube and a passage of the rotor, wherein the conduit is rigid and substantially arched or angled such that an outlet of the conduit is offset a radial distance in a radial direction from the rotor axis, wherein, during use, ejection of pressurized air from the outlet rotates the conduit, and wherein the conduit that is substantially arched or angled remains substantially unflexed during rotation; and a second tube disposed in the first tube and in the conduit, wherein at least a portion of the second tube is configured to rotate about the rotor axis, and wherein an outer surface of the second tube and at least a portion of the inner surface of the conduit form an annulus, wherein the annulus is in fluid communication with the pressurized air source;

wherein the spray nozzle cleaning apparatus is a hand-held apparatus.

3. The spray nozzle cleaning apparatus of claim 2, wherein the second tube is configured to direct liquid from a liquid source coupled to the spray nozzle cleaning apparatus to a surface to be at least partially cleaned.

4. The spray nozzle cleaning apparatus of claim 2, wherein the rotor passage extends from substantially at or near the distal end of the rotor to substantially at or near the proximal end of the rotor.

5. The spray nozzle cleaning apparatus of claim 2, wherein the rotor passage is configured to remain in fluid communication with the first tube passage during rotation of the rotor relative to the first tube about the rotor axis.

6. The spray nozzle cleaning apparatus of claim 2, wherein the second tube comprises a flexible material.

7. The spray nozzle cleaning apparatus of claim 2, wherein ejection of pressurized air from the outlet produces directional components of the pressurized air in the direction of rotation about the rotor axis, and wherein the outlet direction intersects both the rotor axis and the radial direction.

8. The spray nozzle cleaning apparatus of claim 2, wherein the conduit comprises a second outlet in fluid communication with the rotor passage and wherein the outlets are disposed symmetrically about the rotor axis.

9. The spray nozzle cleaning apparatus of claim 2, further comprising a cover disposed about the first tube and the rotor, wherein the rotor is inhibited from contacting the cover during rotation.

10. A spray nozzle, comprising:

a stationary tube in fluid communication with a pressurized air source;

a substantially rigid rotor coupled to the stationery tube, wherein the rotor is in fluid communication with the pressurized air source, and the substantially rigid rotor comprises:

a substantially rigid conduit, the substantially rigid conduit in fluid communication with a passage of the stationary tube and a passage of the rotor, wherein a portion of the conduit is substantially arched such that an outlet of the conduit is offset a radial distance in a radial direction from the rotor axis, wherein ejection of pressurized air from the outlet produces directional components of the pressurized air in the direction of rotation about the rotor axis; and wherein, during use, the pressurized air rotates the rotor; and a fan removably coupled to the rotor, wherein the fan produces axial air flow in the direction of the rotor axis when the rotor rotates.

11. A spray nozzle, comprising:

a stationary tube in fluid communication with a pressurized air source;

a substantially rigid rotor coupled to the stationery tube, wherein the substantially rigid rotor is in fluid communication with the pressurized air source and the substantially rigid rotor comprises:

a substantially rigid conduit, the substantially rigid conduit in fluid communication with the stationary tube and the rotor, wherein a portion of the conduit is substantially arched such that an outlet of the conduit is offset a radial distance in a radial direction from the rotor axis, wherein ejection of pressurized air from the outlet produces directional components of the pressurized air in the direction of rotation about the rotor axis; and wherein, during use, the pressurized air rotates the rotor; and a brush projecting from a distal end of the rotor.

12. A spray nozzle, comprising:

a stationary tube in fluid communication with a pressurized air source;

a substantially rigid rotor coupled to the stationery tube, wherein the rotor is in fluid communication with the pressurized air source, and the substantially rigid rotor comprises:

a substantially rigid conduit, the substantially rigid conduit in fluid communication with the stationary tube and the rotor, wherein a portion of the conduit is substantially arched such that an outlet of the conduit is offset a radial distance in a radial direction from the rotor axis, wherein ejection of pressurized air from the outlet produces directional components of the pressurized air in the direction of rotation about the rotor axis; and wherein an interior surface of the substantially rigid rotor remains substantially undeformed by ejection of the pressurized air through the rotor; and a brush projecting from the distal end of the rotor, wherein the rotor passage extends from substantially at or near the distal end of the rotor to substantially at or near the proximal end of the rotor, wherein the rotor passage is configured to remain in fluid communication with the tube passage during rotation of the rotor relative to the stationary tube about the rotor axis, wherein the outlet port is offset a radial distance in a radial direction from the rotor axis substantially at or near the distal end of the rotor, and wherein ejection of the pressurized air from the outlet port is configured to produce directional components of the pressurized air in the direction of rotation about the rotor axis.

13. A spray apparatus, comprising:

a spray nozzle, comprising:

a stationary tube in fluid communication with a pressurized air source;

a substantially rigid rotor coupled to the stationery tube, wherein the substantially rigid rotor is in fluid communication with the pressurized air source, the substantially rigid rotor comprising:

a substantially rigid conduit, the substantially rigid conduit in fluid communication with a passage of the stationary tube and a passage of the rotor, wherein a portion of the conduit is substantially arched such that an outlet of the conduit is offset a radial distance in a radial direction from the rotor axis, and wherein ejection of pressurized air from the outlet produces directional components of the pressurized air in the direction of rotation about the rotor axis; and a brush projecting from the distal end of the rotor, wherein the rotor passage extends from substantially at or near the distal end of the rotor to substantially at or near the proximal end of the rotor, wherein the rotor passage is configured to remain in fluid communication with the tube passage and the pressurized air source during rotation of the rotor relative to the stationary tube about the rotor axis.

14. The spray nozzle of claim 1, further comprising a hollow inner tube, the hollow inner tube comprising a first end disposed in the stationary tube and a second end disposed in the conduit, wherein at least a portion of the hollow inner tube is configured to rotate about the rotor axis, and wherein at least a portion of an outer surface of the hollow inner tube and at least a portion of the inner surface of the conduit form an annulus, wherein the annulus is in fluid communication with the pressurized air source.

15. The spray nozzle of claim 1, wherein an interior surface of the rotor remains generally undeformed as the rotor is rotated about the rotor axis.

16. The spray nozzle of claim 1, wherein the conduit comprises a second outlet in fluid communication with the rotor passage and wherein the outlets are disposed symmetrically about the rotor axis.

17. The spray nozzle device of claim 11, further comprising a hollow inner tube, the hollow inner tube disposed in the stationary tube and in the conduit, wherein at least a portion of the hollow inner tube is configured to rotate about the rotor axis, and wherein at least a portion of an outer surface of the hollow inner tube and at least a portion of an inner surface of the conduit form an annulus, wherein the annulus is in fluid communication with the pressurized air source.

18. The spray nozzle of claim 1, further comprising a cover disposed about the stationary tube and the rotor, wherein one or more components of the rotor are inhibited from contacting the cover during rotation.

19. The spray nozzle of claim 1, further comprising a bearing, the bearing joining the tube to the rotor.

20. The spray nozzle of claim 1, wherein the outlet is substantially at or near the distal end of the conduit.

21. The spray nozzle of claim 1, wherein the outlet is substantially at or near the distal end of the conduit, and wherein the pressurized air is ejected from the outlet at an oblique angle relative to the conduit.

22. The spray nozzle of claim 1, wherein the tube comprises metallic material.

23. The spray nozzle of claim 1, wherein the tube is slidably coupled to the rotor.

24. The spray nozzle of claim 1, wherein pressurized air ejected from the outlet produces directional components of the pressurized air in the direction of rotation about the rotor axis.

25. The spray nozzle of claim 1, wherein the spray nozzle is portable and configured to provide pressurized air to a surface to at least partially clean the surface, and wherein the spray nozzle is also configured to direct liquid, from a liquid source coupled to the spray nozzle, to the surface.

26. The spray nozzle cleaning apparatus of claim 2, wherein the second tube is configured to carry fluid from a fluid reservoir and out of an end of the second tube.

27. The spray nozzle cleaning apparatus of claim 2, wherein the cleaning apparatus is portable and configured to provide pressurized air to a surface to at least partially clean the surface.

28. The spray nozzle cleaning apparatus of claim 2, wherein the cleaning apparatus is portable and configured to provide pressurized air to a surface to at least partially clean the surface, and wherein the spray nozzle is also configured to direct liquid, from a liquid source coupled to the spray nozzle, to the surface.

29. The spray nozzle cleaning apparatus of claim 2, further comprising a hand-held actuator coupled to the first tube, wherein the hand-held actuator is in fluid communication with the pressurized air source.

30. The spray nozzle cleaning apparatus of claim 2, further comprising a bearing, the bearing joining the first tube to the rotor.

31. The spray nozzle cleaning apparatus of claim 2, wherein the outlet is substantially at or near the distal end of the conduit.

32. The spray nozzle cleaning apparatus of claim 2, wherein the outlet is substantially at or near the distal end of the conduit, and wherein the pressurized air is ejected from the outlet at an oblique angle relative to the conduit.

33. The spray nozzle cleaning apparatus of claim 2, wherein the first tube comprises metallic material.

34. The spray nozzle cleaning apparatus of claim 2, wherein the first tube is slidably coupled to the rotor.

35. The spray nozzle cleaning apparatus of claim 2, wherein a portion of the first tube is positioned in a portion of the rotor.

36. The spray nozzle cleaning apparatus of claim 2, wherein pressurized air ejected from the outlet produces directional components of the pressurized air in the direction of rotation about the rotor axis.

37. The spray nozzle cleaning apparatus of claim 2, further comprising a brush coupled to the apparatus.

38. A spray nozzle, comprising:

a tube in fluid communication with a pressurized air source;

a rotor coupled to the tube, wherein the rotor is in fluid communication with the pressurized air source;

a device configured to reduce friction between the tube and the rotor.

a conduit in fluid communication with the passages of the tube and the rotor, wherein the conduit is rigid and substantially arched or angled such that an outlet of the conduit is offset a radial distance in a radial direction from the rotor axis, wherein pressurized air ejected from the outlet, during use, rotates the conduit, and wherein at least a portion of the conduit remains substantially unflexed during rotation, wherein pressurized air ejected from the outlet produces directional components of pressurized air to rotate the rotor;

a hand-held actuator coupled to the tube, wherein the hand-held actuator is in fluid communication with the pressurized air source, the hand-held actuator being configured to allow a user to actuate the hand-held actuator and thereby allow air from the pressurized air source to flow into the conduit and be ejected from the outlet; and wherein the spray nozzle is configured to provide pressurized air to a surface to at least partially clean the surface.

39. A spray nozzle, comprising:

a tube in fluid communication with a pressurized air source;

a rotor coupled to the tube, wherein the rotor is in fluid communication with the pressurized air source, wherein a portion of the tube is positioned in a portion of the rotor;

a conduit in fluid communication with the passages of the tube and the rotor, wherein the conduit is rigid and substantially arched or angled such that an outlet of the conduit is offset a radial distance in a radial direction from the rotor axis, wherein pressurized air ejected from the outlet, during use, rotates the conduit, and wherein at least a portion of the conduit remains substantially unflexed during rotation, wherein pressurized air ejected from the outlet produces directional components of pressurized air to rotate the rotor;

a hand-held actuator coupled to the tube, wherein the hand-held actuator is in fluid communication with the pressurized air source, the hand-held actuator being configured to allow a user to actuate the hand-held actuator and thereby allow air from the pressurized air source to flow into the conduit and be ejected from the outlet; and wherein the spray nozzle is configured to provide pressurized air to a surface to at least partially clean the surface.

40. A spray nozzle, comprising:

a tube in fluid communication with a pressurized air source;

a rotor coupled to the tube, wherein the rotor is in fluid communication with the pressurized air source, wherein a portion of the tube is positioned in a portion of the rotor;

a conduit in fluid communication with the passages of the tube and the rotor, wherein the conduit is rigid and substantially arched or angled such that an outlet of the conduit is offset a radial distance in a radial direction from the rotor axis, wherein pressurized air ejected from the outlet, during use, rotates the conduit, and wherein at least a portion of the conduit remains substantially unflexed during rotation, wherein pressurized air ejected from the outlet produces directional components of pressurized air to rotate the rotor;

a hand-held actuator coupled to the tube, wherein the hand-held actuator is in fluid communication with the pressurized air source, the hand-held actuator being configured to allow a user to actuate the hand-held actuator and thereby allow air from the pressurized air source to flow into the conduit and be ejected from the outlet;

a brush coupled to the spray nozzle; and wherein the spray nozzle is configured to provide pressurized air to a surface to at least partially clean the surface.

* * * * *